US007322718B2

(12) United States Patent
Setomoto et al.

(10) Patent No.: US 7,322,718 B2
(45) Date of Patent: Jan. 29, 2008

(54) MULTICHIP LED LIGHTING DEVICE

(75) Inventors: Tatsumi Setomoto, Takatsuki (JP); Nobuyuki Matsui, Takatsuki (JP); Tetsushi Tamura, Takatsuki (JP); Noriyasu Tanimoto, Takatsuki (JP); Masanori Shimizu, Kyotanabe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 100 days.

(21) Appl. No.: 10/542,830

(22) PCT Filed: Dec. 22, 2003

(86) PCT No.: PCT/JP03/16428

§ 371 (c)(1),
(2), (4) Date: Jul. 20, 2005

(87) PCT Pub. No.: WO2004/068909

PCT Pub. Date: Aug. 12, 2004

(65) Prior Publication Data

US 2006/0087843 A1 Apr. 27, 2006

(30) Foreign Application Priority Data

Jan. 27, 2003 (JP) ..... 2003-017906
Jul. 18, 2003 (JP) ..... 2003-277052

(51) Int. Cl.

| | |
|---|---|
| ***F21V 23/04*** | (2006.01) |
| ***F21V 21/00*** | (2006.01) |
| ***H05B 37/02*** | (2006.01) |
| *H01R 33/00* | (2006.01) |

(52) U.S. Cl. ..... 362/276; 362/646; 362/249; 362/800; 315/309; 361/731

(58) Field of Classification Search ..... 362/249, 362/652, 640, 646, 362, 373, 367, 218, 219, 362/221, 234, 276, 217, 261–265, 295, 800; 315/291, 307, 309; 361/728–731, 716
See application file for complete search history.

(56) References Cited

U.S. PATENT DOCUMENTS

| | | | | |
|---|---|---|---|---|
| 3,784,844 | A * | 1/1974 | McGrogan, Jr. | 327/538 |
| 4,068,148 | A * | 1/1978 | Nomiya et al. | 315/169.3 |
| 4,298,869 | A * | 11/1981 | Okuno | 345/82 |
| 5,598,068 | A * | 1/1997 | Shirai | 315/185 R |
| 5,765,940 | A * | 6/1998 | Levy et al. | 362/240 |
| 5,939,839 | A * | 8/1999 | Robel et al. | 315/289 |
| 6,144,160 | A * | 11/2000 | Fai | 315/118 |
| 6,489,637 | B1 * | 12/2002 | Sakamoto et al. | 257/98 |
| 6,659,623 | B2 * | 12/2003 | Friend | 362/249 |
| 6,693,556 | B1 * | 2/2004 | Jones et al. | 340/907 |

(Continued)

FOREIGN PATENT DOCUMENTS

EP 0 980 099 4/1998

(Continued)

*Primary Examiner*—Jong-Suk (James) Lee

(57) ABSTRACT

In a module socket, a connecter and a connector are connected by wiring, and three LED modules are connected in parallel with respect to a constant voltage circuit unit via the wiring. Each module has a constant current circuit unit and an LED mounting unit. The constant current circuit unit includes one resistor and two transistors mounted on a surface of a sub-substrate on which a conductive land is formed. The sub-substrate is bonded to a main substrate.

9 Claims, 14 Drawing Sheets

U.S. PATENT DOCUMENTS

| | | | | |
|---|---|---|---|---|
| 6,924,973 | B2 * | 8/2005 | Kim | 361/679 |
| 6,949,772 | B2 * | 9/2005 | Shimizu et al. | 257/99 |
| 6,975,813 | B1 * | 12/2005 | Inoue et al. | 398/197 |
| 6,998,594 | B2 * | 2/2006 | Gaines et al. | 250/205 |
| 2002/0088983 | A1 * | 7/2002 | Yamamoto et al. | 257/99 |
| 2002/0114155 | A1 * | 8/2002 | Katogi et al. | 362/219 |
| 2003/0112627 | A1 * | 6/2003 | Deese | 362/249 |
| 2004/0264195 | A1 * | 12/2004 | Chang et al. | 362/294 |
| 2005/0207165 | A1 * | 9/2005 | Shimizu et al. | 362/362 |

FOREIGN PATENT DOCUMENTS

| | | | |
|---|---|---|---|
| EP | 0 891 120 | | 6/1998 |
| EP | 1059668 | A2 * | 12/2000 |
| EP | 1059678 | A2 * | 12/2000 |
| JP | 63-239873 | | 10/1988 |
| JP | 2001-215913 | | 8/2001 |

* cited by examiner

MULTICHIP LED LIGHTING DEVICE

TECHNICAL FIELD

The present invention relates to a lighting device, and in particular to a lighting device in which light emitting diodes are used as a light source.

BACKGROUND ART

In recent years lighting devices that use light emitting diodes (hereinafter referred to as "LED(s)") have been under development, and some are being put into practical use.

One example of a lighting device that uses LEDs (hereinafter referred to as an "LED lighting device") is one in which LED bare chips are mounted on a substrate (this arrangement is called an "LED module"), an the LED bare chips are made to emit light according to power from a power supply source. A plurality of LED bare chips are generally mounted on the substrate because sufficient light to produce a lighting device is not provided by only one LED bare chip. The LED bare chips are mounted densely in order to produce a more compact lighting device.

In an LED lighting device with such a structure, the LED bare chips exhibit premature deterioration due to the heat generated by the LED bare chips themselves during operation. For this reason, consideration is being given to using metal base substrates due to their high thermal conductivity compared to resin substrates. A metal base substrate has a layered structure that includes a metal layer and an insulative layer (resin), and has a thermal conductivity of approximately 1 W/mK to 10 W/mK.

Furthermore, in order to stabilize the luminous intensity of the LED bare chips during operation in an LED lighting device, power from a power supply source is controlled so as to have a constant current (see Japanese Patent Application Publication No. 2001-215913).

When an LED module has reached the end of its life expectancy, it is necessary to replace the LED module. However, a problem arises that the specifications of the replacement LED module differ from those of the original LED module.

Specifically, LEDs have a significantly longer life expectancy than conventional incandescent lamps, and with rapid progress in the development of LEDs, it is unlikely that the specifications (for example the Vf of the LED bare chips) of LED modules at the time of replacement will be the same as the specifications when the lighting device was designed.

In terms of a device that uses the circuit described in the aforementioned patent document, the circuit structure of the device is such that the LED module and the circuit are separate, and the circuit is composed of a converter circuit and a constant current circuit.

With this circuit, when a number of LED modules are provided in parallel, there is only one converter circuit feedback signal. Even if the number of LED modules is increased, there is still only one main LED module used as a reference.

In other words, the control depends strongly on the LED module connected to extract the feedback signal, and control of other LED modules becomes dependant on the main LED module. This is not ideal for the LED modules. For this reason, when replacing the LED module in this device, it is preferable to use an LED module that has the same properties (specifications) as the original LED modules.

If a unit made up of a most current LED module is used to replace the main LED module, the capability of the dependant LED modules will be reduced. In the same way, if a dependant LED module is replaced, the capability of the replacement dependant module will suffer.

In this way, according to the aforementioned patent document, it is difficult to obtain maximum performance from each LED module because it is not possible to compensate for differences in LED performance of the LED modules.

For this reason, in order to maintain LED module performance in such devices, it is necessary to either recommence manufacturing of LED modules with the specifications at the time of design, or to keep a stock of such LED modules. Furthermore, an LED module cannot be replaced with the most current LED module that is superior in aspects such as Vf of the LED bare chip.

DISCLOSURE OF THE INVENTION

In view of the stated problems, the object of the present invention is to provide a lighting device in which stability of luminous intensity of an LED bare chip in an LED module is improved, and in which the LED module can be easily replaced or expanded in number with an LED module of differing specifications.

In order to achieve the stated object, the present invention is a lighting device including an LED module, the LED module being composed of a main substrate, a light emitting diode bare chip provided on a main surface of the main substrate, a power supply terminal for receiving power from a power supply source, and a luminous intensity stabilization circuit provided between and electrically connected to the power supply terminal and the light emitting diode bare chip.

In this lighting device, an illumination stabilizing circuit such as a constant current circuit is provided in the power supply path for supplying power to the LED bare chip of the LED module. Therefore, luminous intensity of the LED bare chip during operation can be stabilized.

Furthermore, since the luminous intensity stabilizing circuit is provided in the LED module, the LED bare chip can emit light with a stable luminous intensity without providing a luminous intensity stabilizing circuit such as a constant current circuit on the power supply side of the LED module.

Furthermore, if the LED module is made to be detachable, even when the LED module is replaced, if the new LED module includes a luminous intensity stabilizing circuit that is compatible with the LED bare chip mounted on the new LED module, the LED bare chip can also be made to emit light with stable luminous intensity.

In addition, in the lighting device of the present invention the number of LED modules can be easily expanded. Note that if the main substrate is a metal base substrate that is composed of a metal layer and an insulative layer, premature deterioration of the LED bare chip due to the heat generated by the LED bare chip during operation can be prevented.

Consequently, in the lighting device of the present invention, luminous intensity of the LED bare chip in the LED module can be stabilized, and if, for example, the LED module is detachable, the LED module can be easily replaced or expanded in number with an LED module having different specifications.

Furthermore, use of a constant current circuit as the luminous intensity stabilizing circuit is preferable in terms of stability of luminous intensity of the LED bare chip, since power with a constant current can be supplied to the LED bare chip. In particular, if power with constant voltage is supplied by the power supply source to the constant current circuit of the LED module, the luminous intensity of the LED bare chip can be stabilized with high precision.

When a constant current circuit is provided in the lighting device, the constant current circuit can be formed on a main substrate (the metal base substrate) with a die bonding method using silver paste, or by attaching a sub-substrate on which the constant current circuit has been pre-formed to the main substrate. The method of using a sub-substrate is particularly favorable as the constant current circuit can be formed on the main substrate without a steep rise in the cost of manufacturing.

Since the LED bare chip is ordinarily mounted to the conductive land on the insulative layer of the metal base substrate using a method such as FCB (flip chip bonding) according to ultrasonic bonding, it is necessary to keep the surface of the substrate clean before mounting the LED bare chips, and a reflow method cannot be used to mount the components of the constant current circuit.

In contrast, if the constant current circuit is provided on a sub-substrate, a reflow method can be used to mount the components on the sub-substrate.

The sub-substrate may be made of resin/ceramic or Si.

The lighting device may have the single LED module or a plurality of LED modules. In the case of a plurality of LED modules, if the LED modules are connected in parallel with respect to the power supply source, the LED modules can be added to easily. In other words, in the present invention the number of LED modules is easily expandable.

Note that as long as each LED module has its own constant current circuit, it is not necessary for other structural aspects, such as the number of mounted LED bare chips, to be the same.

Furthermore, it is preferable for each LED module to be detachable from the socket that is connected to the power supply source, to enable each LED module to be easily replaced when it has reached the end of its life, and to improve workability when replacing the LED modules.

Furthermore, a so-called metal base substrate that has a layered structure of an insulative layer and a metal layer is used as the main substrate in the LED module in the lighting device. Compared to a substrate made of resin only, this metal base substrate efficiently expels heat generated by the LED bare chips during operation, and is effective in controlling deterioration of the LED bare chips by heat.

Furthermore, by providing a thermal element (such as a thermistor) in a vicinity of the LED bare chips in the LED module, and connecting the thermal element to the luminous intensity stabilization circuit, current supply to the LED bare chip can be reduced when the temperature of the LED bare chip rises to be equal to or greater than a pre-set temperature.

Adjusting current supply in this way according to the temperature of LED bare chips is favorable in that it lengthens the life span of the LED bare chips.

Furthermore, the LED module may further include an abnormality detection unit that is provided in a vicinity of the light emitting diode bare chip and that detects an abnormality in the light emitting diode bare chip, and the constant voltage circuit may include a control unit that reduces or stops provision of current to the LED module when the abnormality detection unit detects an abnormality in the light emitting diode bare chip. Alternatively, the light emitting diode bare chip may be one of a plurality included in the LED module that are divided into groups of light emitting diodes that are connected in series, the groups being connected in parallel with each other, and each group having a current detection unit connected thereto, and the constant voltage circuit may include a control unit that reduces or stops supply of current to the LED module when one of the current detection units detects an abnormality in an amount of current in the light emitting diode bare chips. Such structures prevents light emission continuing when an abnormality occurs in the LED bare chips, and is favorable in terms of safety.

Furthermore, it is preferable that the LED module further includes a Zener diode connected to the luminous intensity stabilization circuit, in parallel with the light emitting diode bare chip. This structure is favorable in terms of protecting the LED bare chip from static electricity.

BEST MODE FOR CARRYING OUT THE INVENTION

Overall Structure

Figure 1:
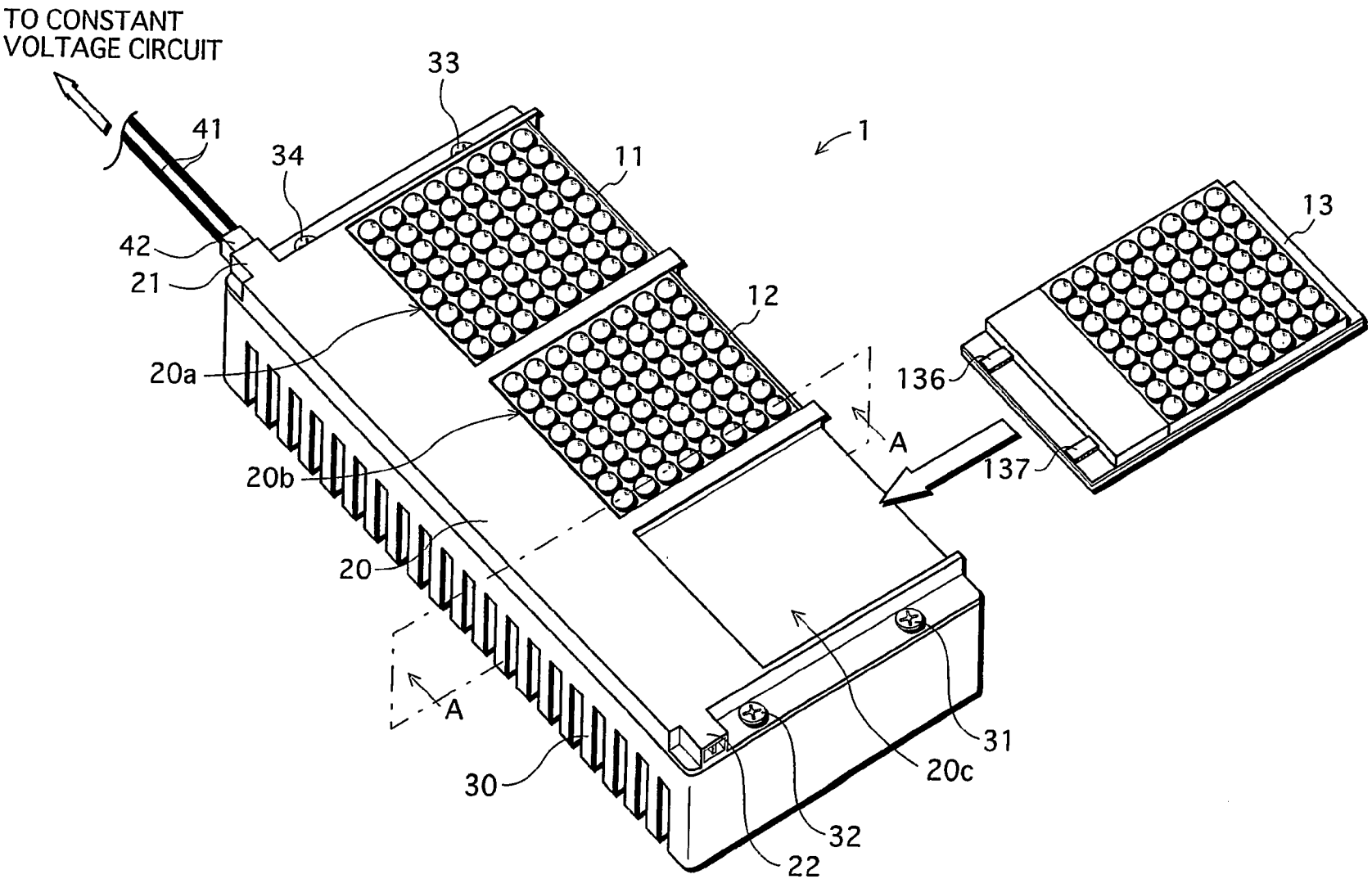
FIG. 1 is a perspective drawing of relevant parts of an LED lighting device 1 of an embodiment of the present invention.
Figure 2:
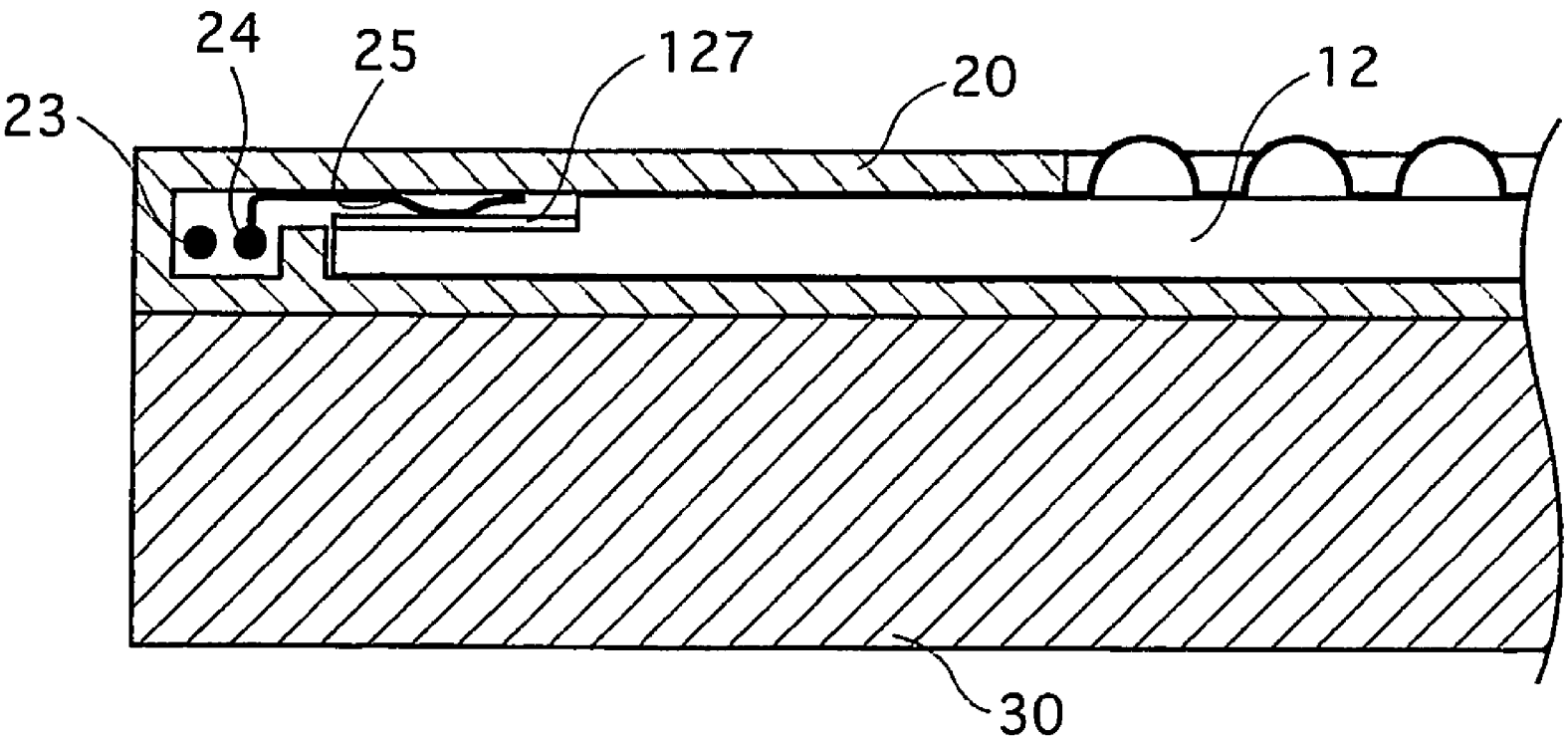
FIG. 2 is a cross sectional drawing showing a portion indicated by A-A in the LED lighting device 1 of FIG. 1.
Figure 3:
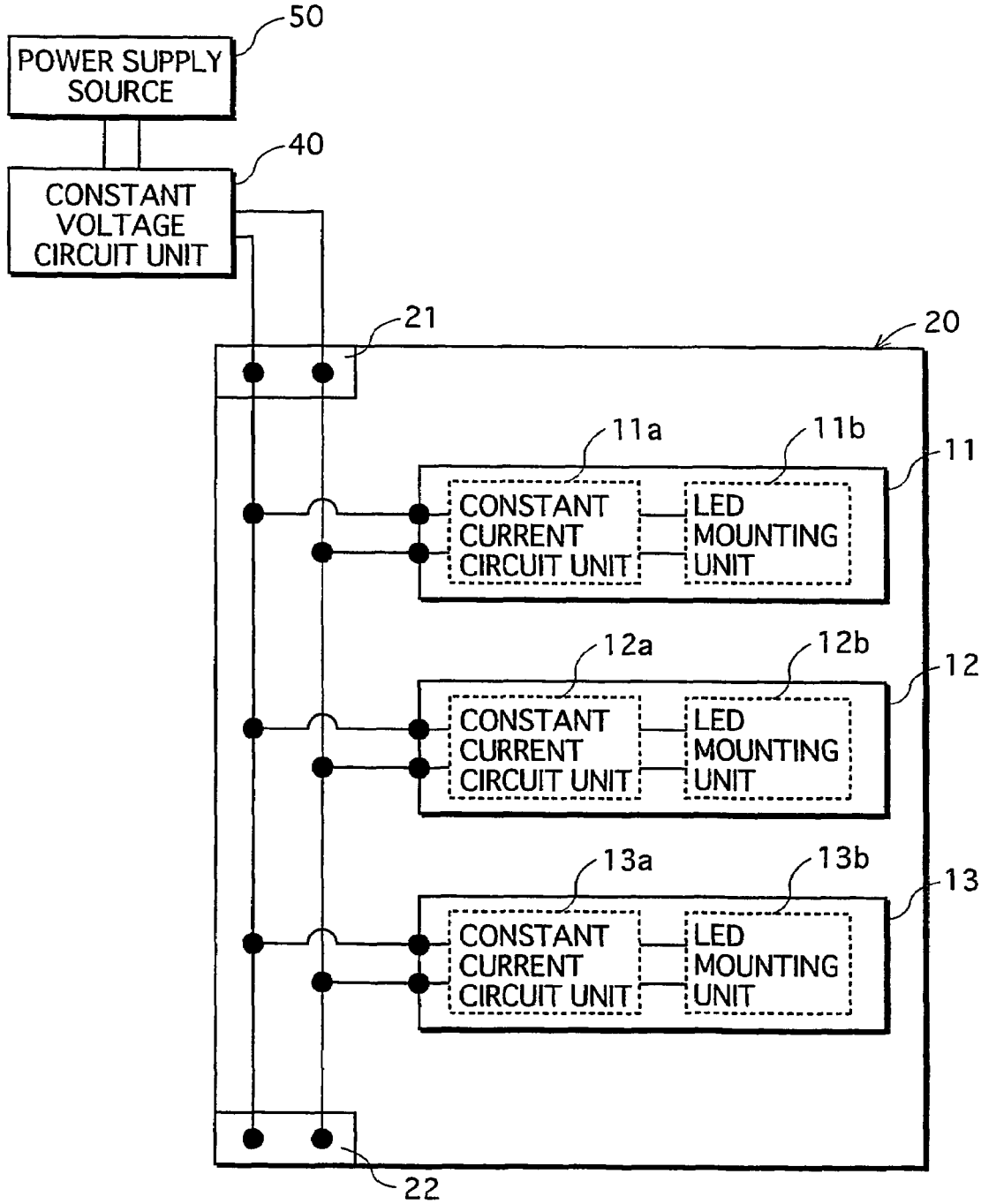
FIG. 3 is a block drawing showing circuits of the LED lighting device 1 of FIG. 1.

The following describes the overall structure of the LED lighting device 1 of the preferred embodiment of the present invention with use of FIGS. 1, 2 and 3. FIG. 1 is a perspective drawing of relevant parts of the LED lighting device 1, FIG. 2 is a cross sectional drawing of part of the LED lighting device 1, and FIG. 3 is a block diagram showing the circuit structure.

As shown in FIG. 1, the LED lighting device 1 has three LED modules 11, 12 and 13, a module socket 20 into which the LED modules 11, 12 and 13 are loaded, and a heat radiating plate 30 that is attached to the back side of the module socket 20.

In addition, although not illustrated in FIG. 1, the LED lighting device 1 has a constant voltage circuit unit that is connected to a power supply source, and a lead 41 that extends from the constant voltage circuit unit to be connected to a connector 42. The connector 42 is inserted in a male connector 21 provided in the module socket 20.

The LED modules 11, 12 and 13 are connected to wiring 23 and 24 (not shown in FIG. 1) in the module socket 20, via respective connection terminals (terminals 136 and 137 in the case of the LED module 13).

The module socket 20 is composed of a metal frame which is made of stainless steel or the like, and includes magazine units 20*a*, 20*b* and 20*c* into which the LED modules 11, 12 and 13 are loaded.

Furthermore, the module socket 20 has two connectors 21 and 22. The connector 42 to which the lead 41 is connected from the constant voltage circuit unit as described is mountable in the connector 21. The connectors 21 and 22 are connected to each other by the wiring 23 and 24 (not shown in FIG. 1) inside the module socket 20.

The other connector 22 is for use when expanding the number of LED modules. In other words, module sockets can be added in the LED lighting device 1 via the connector 22.

In order to load the LED modules 11, 12 and 13 in the magazine units 20*a*, 20*b* and 20*c*, respectively, the LED modules 11, 12 and 13 are slid into the respective magazine units 20*a*, 20*b* and 20*c* in a direction towards the bottom left of the drawing, with both side parts fitted into the side channels of respective the magazine units 20*a*, 20*b* and 20*c*.

When loaded completely, as the LED modules 11 and 12 are shown loaded into the magazine units 20*a* and 20*b* with the connection terminals of the LED modules 11 and 12 not externally exposed in FIG. 1, the connection terminals of the LED modules 11 and 12 are in a state of connection with the terminals provided inside the module socket.

Specifically, as shown in FIG. 2, when the LED module 12 is loaded in the magazine unit 20*b*, a connection terminal 127 of the LED module 12 and a terminal 25 of the module socket 20 contact each other, thereby being in a state of electrical connection.

The terminal 25 is bent in part to connect terminal, thus pushing against the connection terminal 127 when the LED module 12 is loaded. Accordingly, the LED module 12 cannot be removed easily from the module socket 20 due to self weight and the like.

Note that while FIG. 2 shows the connection between the terminal 25, the wiring 24 and the connection terminal 127 of the LED module 12, the other connection terminal of the LED module 12, and the connection terminals of the LED modules 11 and 13 are also connected to respective terminals in the magazine units 20*a* and 20*b* in the module socket 20 (not illustrated in FIG. 2).

Returning to FIG. 1, the heat radiating plate 30 is for releasing heat generated by the LED bare chips of the LED modules 11, 12 and 13 during operation, and is attached to the back side of the module socket 20 by, for example, screws 31, 32, 33 and 34.

The following describes the circuit structure of the LED lighting device 1 with use of FIG. 3.

As shown in FIG. 3, a constant voltage circuit unit 40 connected to a power supply source 50, which is a commercial power supply or the like, is connected to the module socket 20 via the connector 42. Furthermore, in the module socket 20, the three LED modules 11, 12 and 13 are connected in parallel with respect to the constant voltage circuit unit 40.

The LED modules 11, 12 and 13 are composed of constant current circuit units 11*a*, 12*a* and 13*a* and LED mounting units 11*b*, 12*b* and 13*b*, respectively.

Note that since the LED modules 11, 12 and 13 are connected in parallel and have respective constant current circuit units 11*a*, 12*a* and 13*a*, it is not necessary for all three of the LED modules 11, 12 and 13 to be mounted on the module socket 20. Instead, it is sufficient for only one or two of the LED modules 11, 12 and 13 to be mounted in order for the device to operate. Furthermore, as described earlier, the LED modules may be added to using the connector 22.

Structure of the LED Modules

Figure 4:
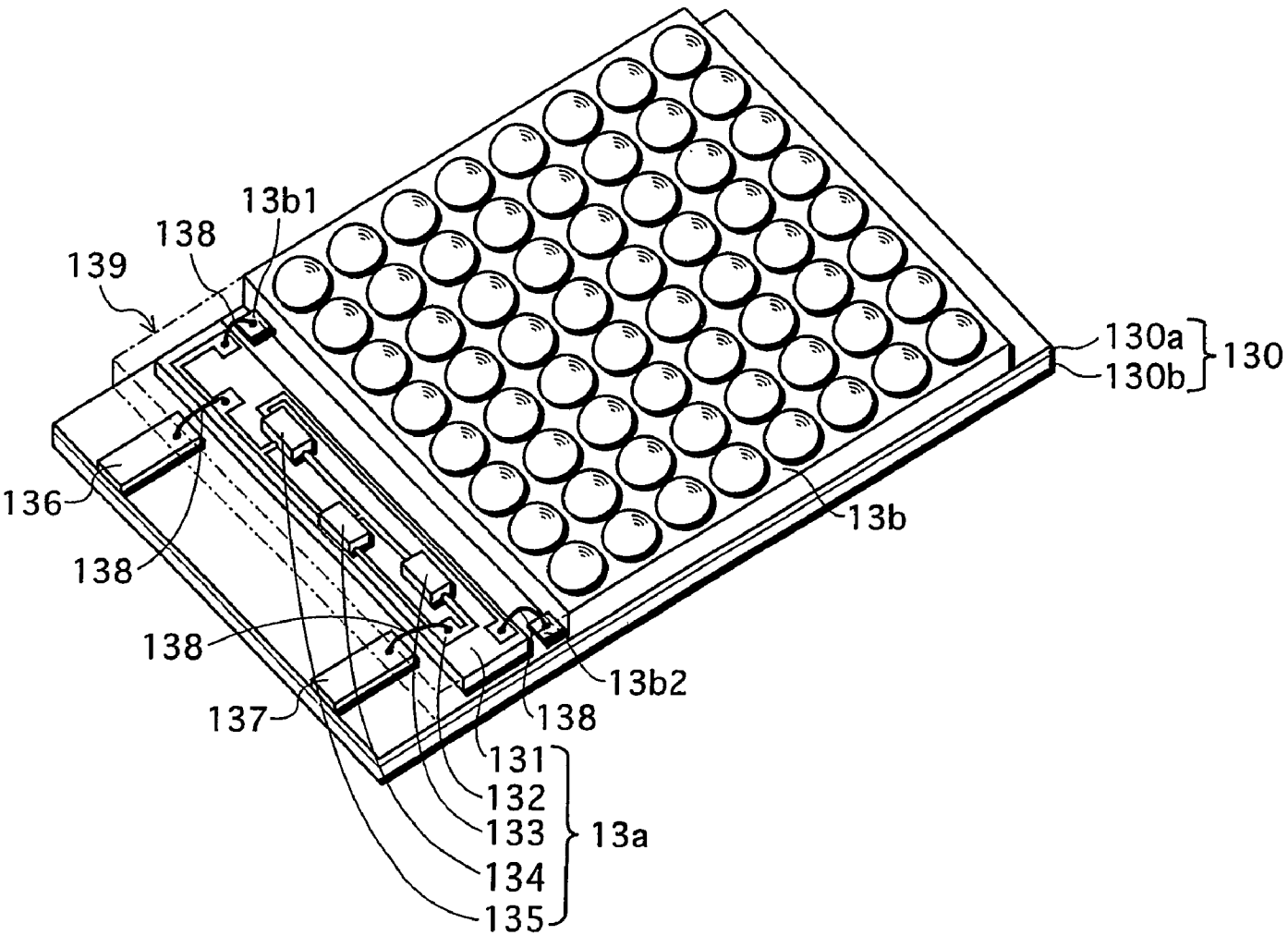
FIG. 4 is a perspective drawing (partially transparent view) showing an LED module 13 that is a compositional element of the LED lighting device 1 of FIG. 1.
Figure 5:
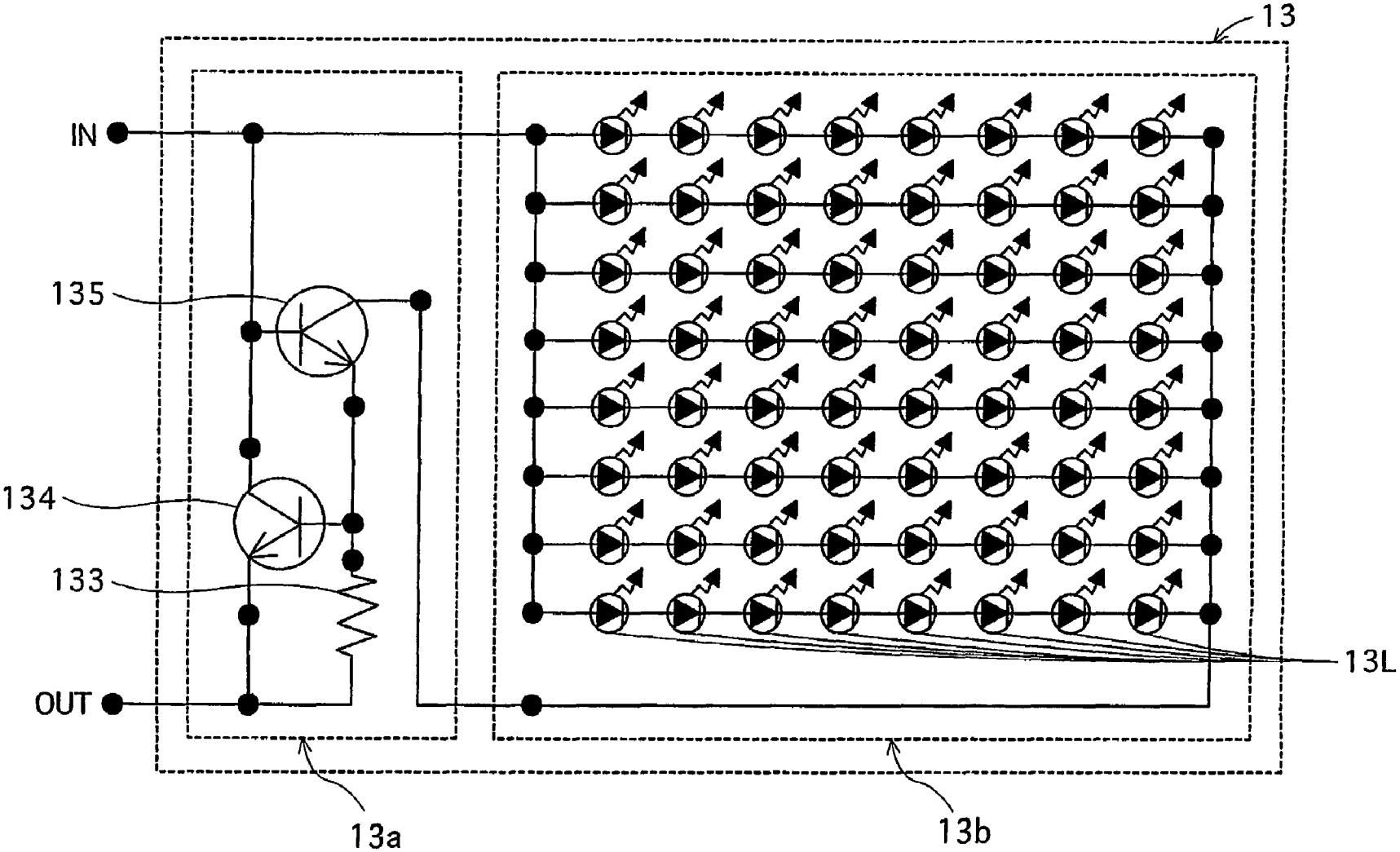
FIG. 5 is a circuit diagram of the LED module 13 of FIG. 4.

The following describes the structure of the LED modules 11, 12 and 13 with use of FIGS. 4 and 5. FIG. 4 is a perspective drawing (partially transparent view) of the LED module 13, and FIG. 5 is a circuit diagram of the LED module 13.

As shown in FIG. 4, the LED module 13 includes a main substrate 130 on which the constant current circuit unit 13*a* and the LED mounting unit 13*b* are formed. Furthermore, connection terminals 136 and 137 are provided on the of the main substrate 130 that appears in the bottom left of the drawing.

The main substrate 130 has a multi-layered structure, composed of an insulative layer 130*a* of resin or the like formed on a metal layer 130*b* of Al or the like. The insulative layer 130*a* and the metal layer 130*b* are thermally bonded, and therefore the main substrate 130 has a favorable thermal conductivity rate of 1 WmK to 10 WmK.

For this reason, the main substrate 130 is superior in terms of thermal conductivity to, for example, a substrate made of resin only. In other words, the main substrate 130 is ideal as a substrate for use in a lighting device or the like in which LED bare chips are densely mounted. A conductive land (not illustrated) of a desired pattern is formed on the insulative layer 130*a*.

The insulative layer 130*a* is formed from a compound material that includes an inorganic filler (such as $Al_2O_3$, MgO, BN, $SiO_2$, SiC, $Si_3N_4$, or AlN) and a resin component.

Although not illustrated, in the LED mounting unit 13*b* a total of 64 LED bare chips are mounted on the conductive land of the main substrate 130 using FCB (flip chip bonding) according to an ultrasonic bonding method. A reflective plate and phosphor resin are disposed on this arrangement, which is then sealed with resin. When sealing, hemispherical shaped lenses are formed in places corresponding to the LED bare chips.

Furthermore, parts of the conductive land extend from one side of the sealing resin of the LED mounting unit 13, and function as terminals 13*b*1 and 13*b*2 for connecting to the constant current circuit unit 13*a* described below.

As shown in FIG. 4, the constant current circuit unit 13*a* is provided in the area on the main substrate 130 between the LED mounting unit 13*b* and the connection terminals 136 and 137.

Specifically, the constant current circuit unit 13*a* is composed of a sub-substrate 131 on which a conductive land 132 is formed in a desired pattern, and one resistor 133 and two transistors 134 and 135 mounted in advance on the sub-substrate 131 using a reflow method.

The sub-substrate 131 on which the constant current circuit has been formed as described is then attached to the aforementioned area of the main substrate 130 using a resin material or the like.

Bonding wire 138 made of Au or the like is used to connect the constant current circuit unit 13*a* with the terminals 13*b*1 and 13*b*2 of the LED mounting unit 13*b* and with the terminals 136 and 137.

Furthermore, although the circuit structure on the sub-substrate 131 is shown in FIG. 4 in a manner that aids comprehension, the sub-substrate 131, including the connection portions, on which the circuit is formed is actually sealed with resin (resin sealing unit 139) that is shown with broken lines in FIG. 4.

The following describes the circuit structure of the LED module 13 in which the constant current circuit unit 13*a* and the LED mounting unit 13*b* are connected as shown in FIG. 3 in more detail with use of FIG. 5.

As shown in FIG. 5, the LED mounting unit 13*b* has a structure in which a total of 64 LED bare chips 13L are arranged in eight lines and eight rows.

Furthermore, the constant current circuit unit 13*a* has a general constant current circuit composed of one resistor 133 and two NPN transistors 134 and 135. Specifically, the resistor 133 is inserted between the emitter and the base of the transistor 134, and the base of the transistor 134 is connected to the emitter of the other transistor 135. The collector of the transistor 134 is connected to the base of the transistor 135.

The base of the transistor 135 is connected to the input connection terminal 136 and one terminal 13*b*1 of the LED mounting unit 13*b*, while the collector is connected to the other terminal 13*b*2 of the LED mounting unit 13*b*.

The emitter of the transistor 134 is connected to the output connection terminal 137.

In this way, the constant current circuit 13*a*, which is inserted in the power supply path in the LED module 13, controls so that power supplied by the constant voltage circuit unit 40 has constant current, and supplies the resulting power to the LED mounting unit 13*b*. In other words, during operation of the LED module 13, the constant current circuit unit 13*a* functions to stabilize luminous intensity of the LED bare chips.

Note that the LED modules 11 and 12 have the same structure as the LED module 13.

Formation of the Constant Current Circuit Unit 13*a*

Figure 6A:
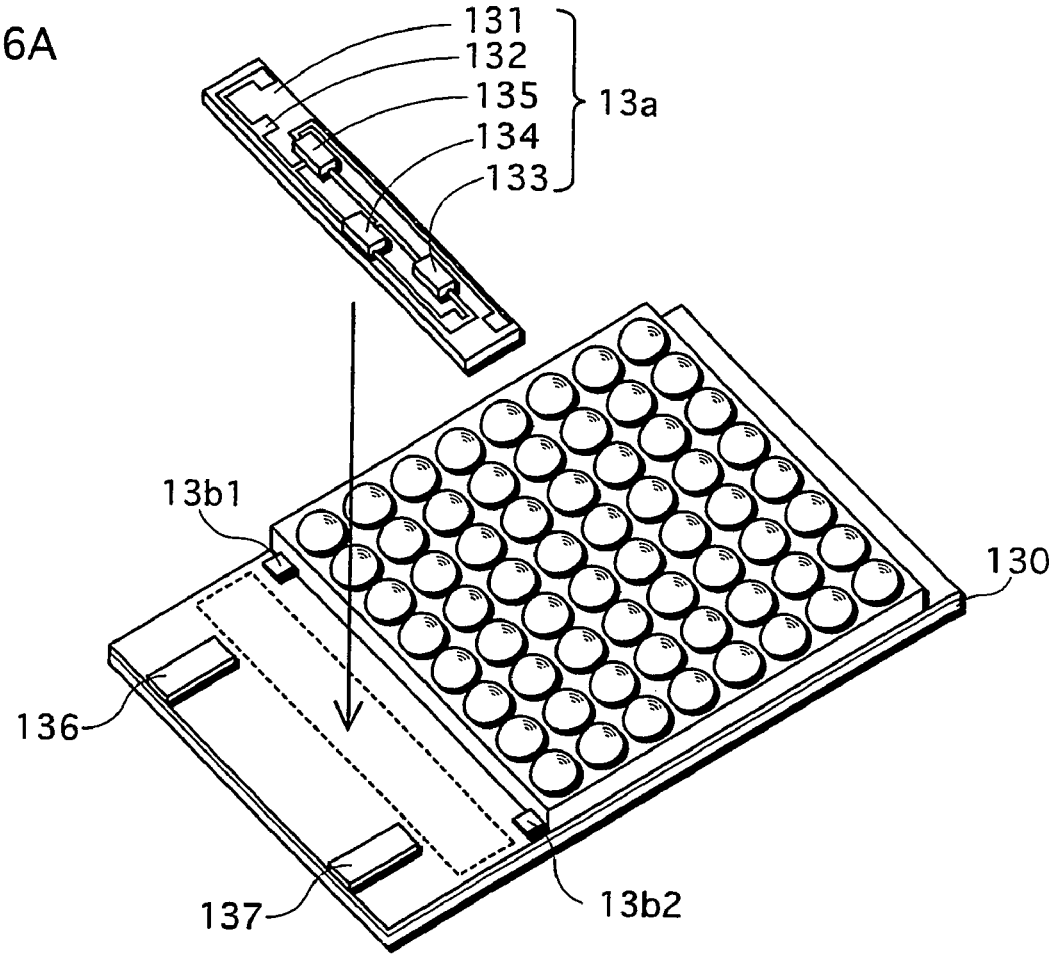
FIG. 6 is a process diagram showing a method of forming the LED module 13 of FIG. 4.
Figure 6B:
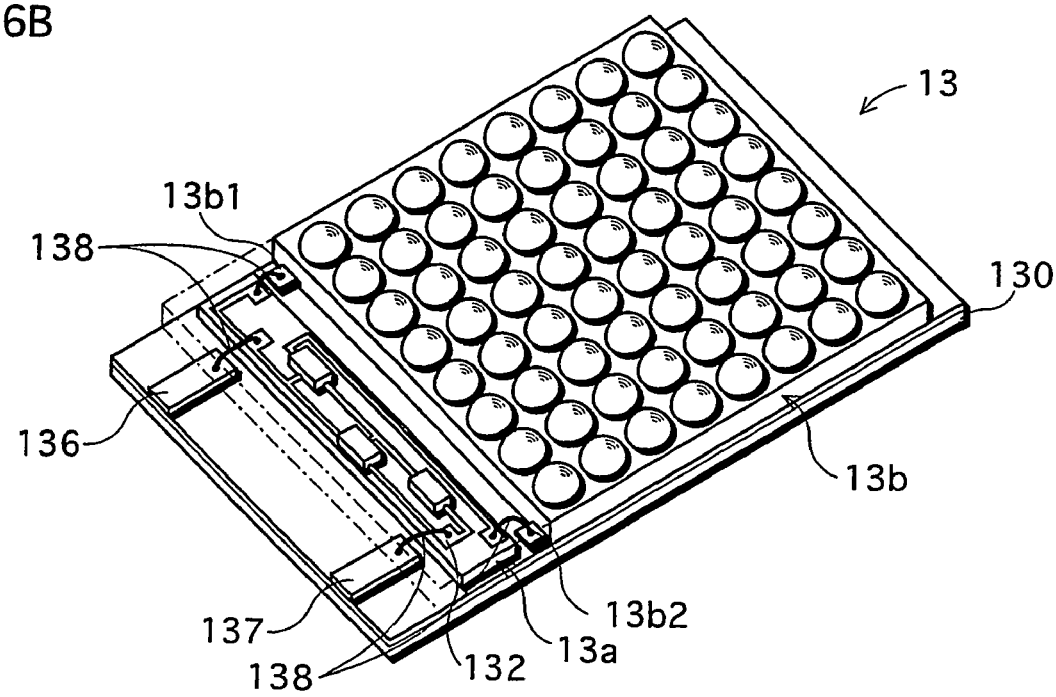

The following describes the method used to form the constant current circuit unit 13*a* when forming the LED module 13, with use of FIGS. 6A and 6B.

The resistor 133 and the transistors 134 and 135 are mounted, using a reflow method, on the conductive land 132 which is on the main surface of the resin sub-substrate 131 as shown in FIG. 6A. The sub-substrate 131 on which the constant current circuit is composed according to the components is attached using resin to the main substrate 130 on which the LED mounting unit 13*b* has been formed in advance.

Next, part of the conductive land on the sub-substrate 131 is connected with terminals 13*b*1 and 13*b*2 and with the connection terminals 136 and 137 using the bonding wire 138 which is made of Au.

Finally, the whole of the constant current circuit unit 13*a*, including the bonding portion, is sealed with resin, thereby completing the formation of the constant current circuit unit 13*a* in the LED module 13.

Advantages of the Led Lighting Device 1

In the LED lighting device 1 having the described structure, each of the three LED modules 11, 12 and 13 has a constant current circuit such as the constant current circuit 13*a*, as shown in FIG. 3, and the LED modules 11, 12 and 13 are connected in parallel. This means that the number of LED modules can be expanded.

In other words, if the number is to be expanded so that the LED lighting device 1 has four or more LED modules, this can be done using another module socket 20 having the same structure shown in FIG. 1. Even when the number of LED modules is increased, constant current control is performed in each LED module, and therefore stabilization of the luminous intensity of the LED bare chips is improved.

Furthermore, even if the LED bare chips mounted on the LED module differ in terms of current rating, operation can be performed with stable luminous intensity by providing individual constant current circuit units 13*a* for each LED module according to the specifications of the mounted LED bare chips.

In other words, when replacing an LED module in the LED lighting apparatus 1, it is possible to use a replacement LED module whose LED bare chip specifications differ to those at the time the LED lighting device 1 was designed.

Furthermore, since metal base substrates are used as the main substrate 130 in each of the LED modules 11, 12 and 13, heat generated by the LED bare chips 13L can be efficiently transferred to the heat radiating plate 30. In other words, when the substrate of the LED module is a resin substrate as in a light source device disclosed in Japanese Patent Application Publication No. 2002-304902, different types of circuits can be provided easily on the same substrate, but the LED bare chips cannot be mounted densely because of problems such as emission processing emission of heat generated by the LED bare chips. Consequently, it is difficult for such a device to be put into practical use as a lighting device.

In contrast, with LED modules 11, 12 and 13 in which a metal base substrate is used as the main substrate 130 as in the present embodiment, deterioration of the LED bare chips 13L according to heat can be controlled, even if a total of 64 LED bare chips 13L are mounted densely.

In addition, since the constant current circuit units 11*a*, 12*a* and 13*a* are formed in the LED modules 11, 12 and 13 by first mounting the electronic components 133 to 135 etc. on the sub-substrate in advance using a reflow method, and then the sub-substrate 131 is attached to the main substrate 130 as shown in FIGS. 6A and 6B, the LED bare chips 13L are not subject to damage due to heat in the reflowing when forming the circuit. This is advantageous is terms of cost.

Note that the sub-substrate 131 may be attached to the main substrate 130 after the formation of the LED mounting unit 13*b* as shown in FIGS. 6A and 6B, or before forming the LED mounting unit 13*b*.

In particular, if the sub-substrate 131 is attached before the LED mounting unit 13*b* is formed, the resin lens parts of the LED mounting unit 13*b* can be formed when sealing the LED bare chips 13L with resin, as part of the same process, thereby improving work efficiency.

Accordingly, the LED lighting device 1 of the present embodiment improves stability of luminous intensity of LED bare chips 13L mounted densely on the main substrate 130, and makes the LED modules 11, 12 and 13 easily expandable in number and replaceable. Furthermore, when expanding or replacing the LED modules 11, 12 and 13, it is not necessary to use an LED module having the same specifications.

<First Modification>

Figure 7:
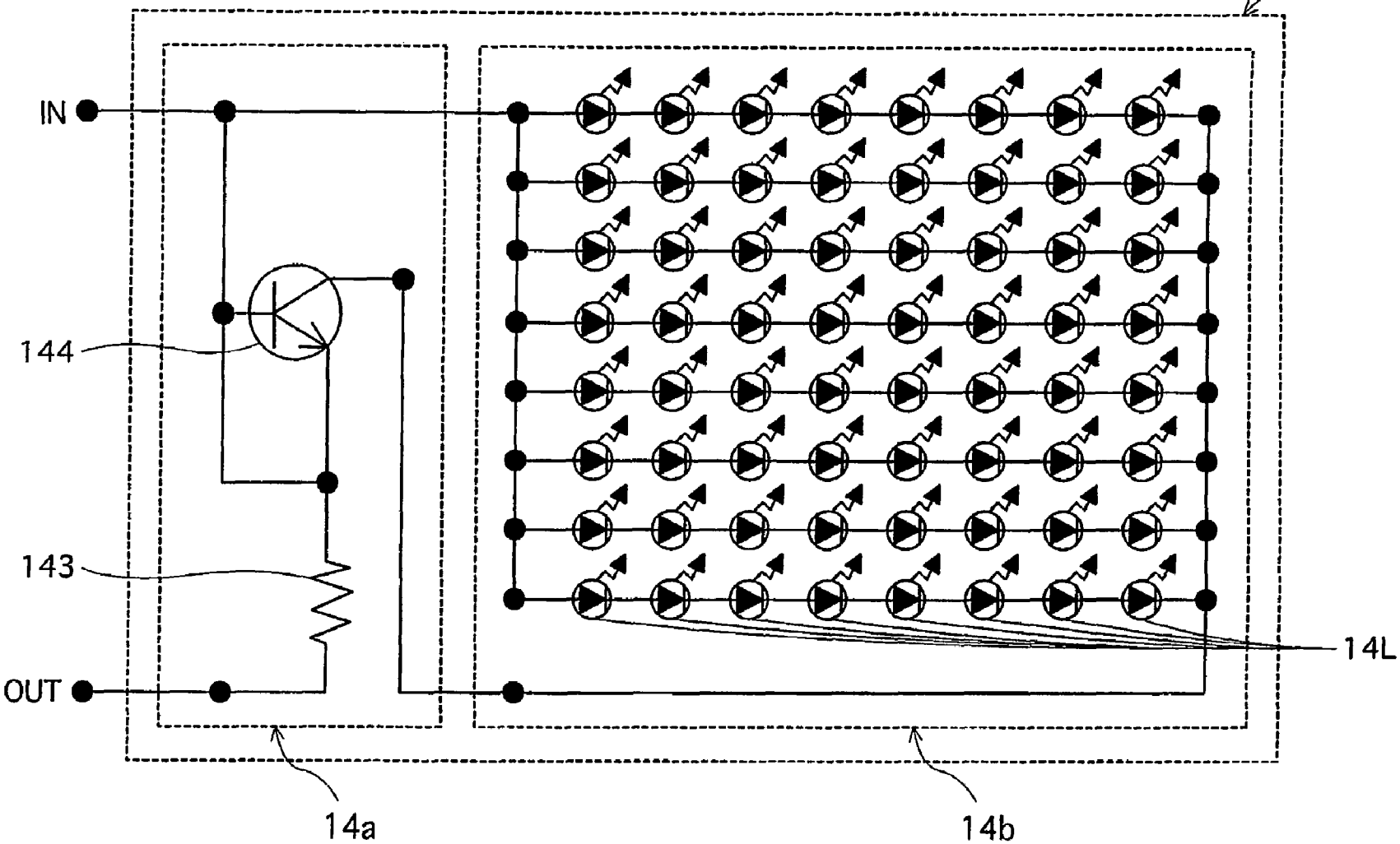
FIG. 7 is a circuit diagram of the LED module 14 of a first modification.

The following describes the LED lighting device of a first modification with use of FIG. 7. FIG. 7 shows the circuit structure of an LED module 14, which differs to the preferred embodiment of the invention.

As shown in FIG. 7, the LED module 14 of the present modification has an LED mounting unit 14*b* composed of 64 LED bare chips 14L in the same way as the preferred embodiment.

A constant current circuit unit 14*a* differs from the preferred embodiment in that it is composed of one resistor 143 and one transistor 144.

Specifically, the input connection terminal is connected to one of the terminals of the LED mounting unit 14*b* and the base of the transistor 144. The output connection terminal is connected to one end of the resistor 143, and the other end of the resistor 143 is connected to the emitter and the base of the transistor 144.

The other end of the LED mounting unit 14*b* is connected to the collector of the transistor 144.

The LED module 14 having the constant current circuit unit 14*a* with the described structure is able to supply power with a constant current to the LED bare chips 14L with a simpler circuit structure than the LED module 13 of FIG. 5.

Consequently, the LED lighting device having the LED module 14 is able to stabilize the luminous intensity of the LED bare chips 14L densely mounted on the main substrate 130, for less cost than the LED lighting device 1 described earlier. In addition, in the same way as the LED lighting device 1, the LED lighting device having the LED module enables easy expansion and replacement of LED modules 11, 12 and 13.

Furthermore, the LED module 13 is superior in terms of stabilization of luminous intensity.

Note that the LED lighting device described here is the same as the LED lighting device 1 in respects other than the circuit structure of the constant current circuit unit 14*a*.

<Second Modification>

Figure 8:
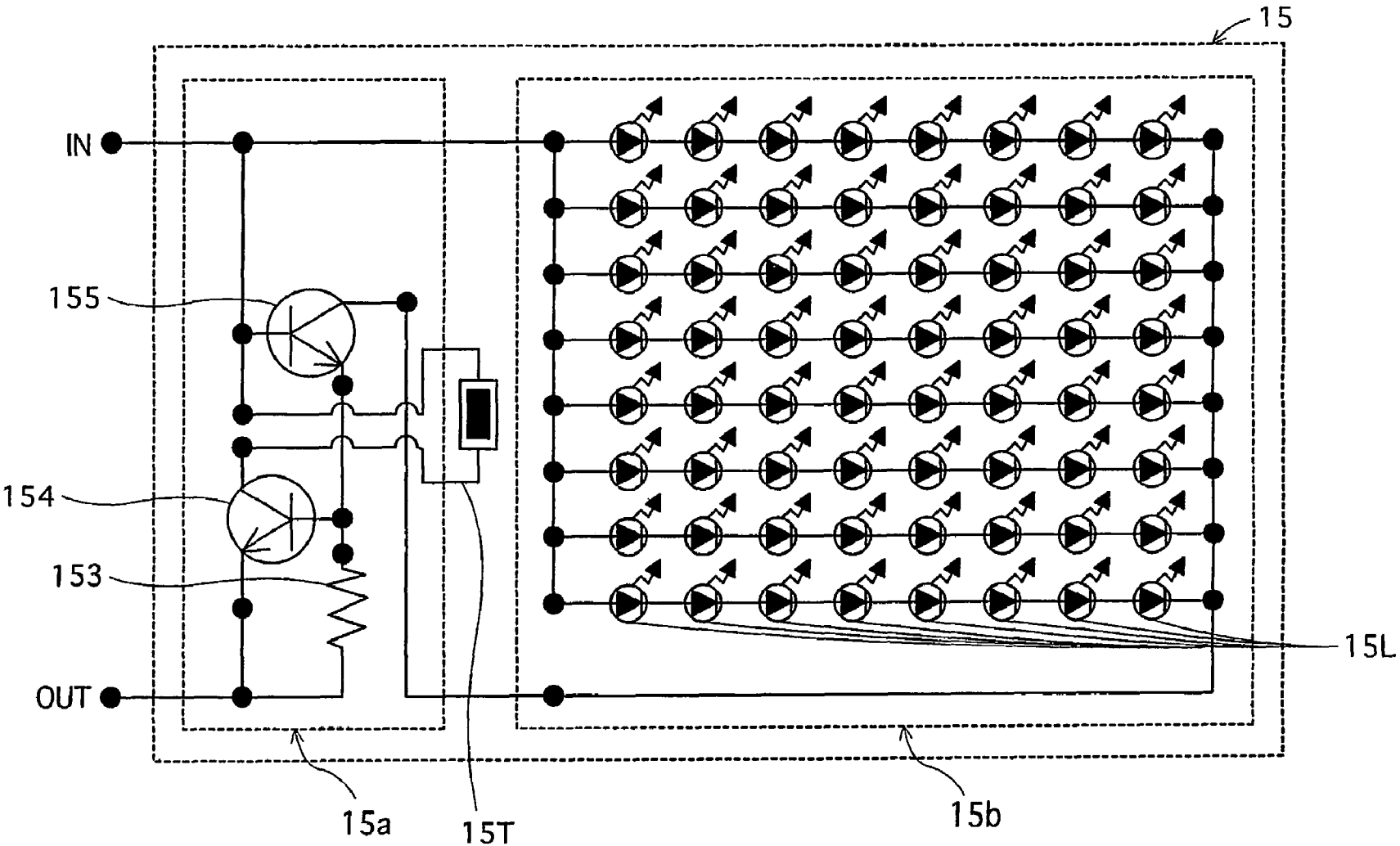
FIG. 8 is a circuit diagram of an LED module 15 of a second modification.

The following describes an LED module 15 of the second modification with use of FIG. 8.

As shown in FIG. 8, in the LED module 15 of the present modification a constant current circuit unit 15*a* differs partly in terms of structure from the preferred embodiment, and has a thermistor 15T.

Specifically, in the LED module 15, the thermistor 15T is inserted between the collector of a transistor 154 and the base of a transistor 155 in the constant current circuit unit 15*a*. Although not illustrated, the thermistor 15T is fixed to the surface of the insulative layer of the main substrate by silicone resin or the like.

In the LED module 15 having such a structure, the heat generated by the LED bare chips 15L during operation can be monitored in substantially real time by the thermistor 15T, and the current to the LED mounting unit 15*b* controlled accordingly.

Although the thermistor 15T is described here as being provided on the surface of the insulative layer, it is able to sense the heat from the LED bare chips 15L in substantially real time because of the favorable thermal conductivity of the metal base substrate.

Consequently, a LED lighting device having the LED module 15 of the present modification is able to maintain the life expectancy of the LED bare chips 15L, in addition to the same advantages as the LED lighting device 1.

Note that the thermistor 15T is not limited to being positioned on the surface of the insulative layer. The same effects can be obtained wherever the thermistor 15T is positioned on the substrate, due to the metal base having superior heat conductivity. For instance, a recess may be provided in the insulative layer that is sufficient in size and depth for the thermistor 15T to be embedded in and reach the metal layer, and the thermistor 15T inserted therein.

<Third Modification>

Figure 9:
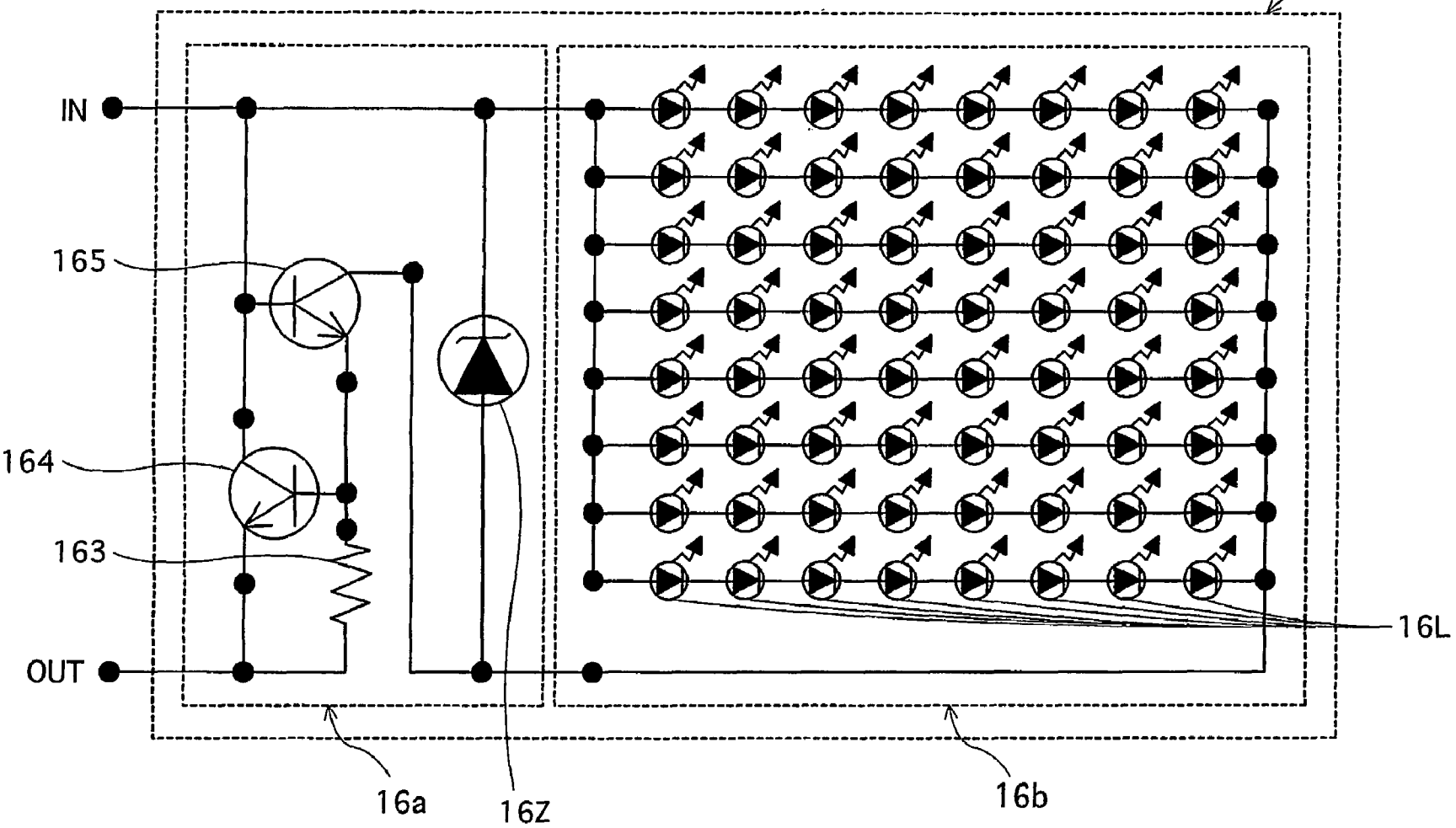
FIG. 9 is a circuit diagram of an LED module 16 of a third modification.

The following describes an LED module 16 of a third modification with use of FIG. 9.

As shown in FIG. 9, the circuit of the LED module 16 differs from that of the LED module 13 of the preferred embodiment, in that a constant voltage diode (hereinafter called a "Zener diode") 16Z is inserted parallel to the LED mounting unit 16*b*. Other than this, the circuit structure and the structure of the LED module are the same as those in the preferred embodiment.

In the LED module 16 that includes the Zener diode as described, the LED bare chips 16L, the wiring, and the like are protected from static electricity.

Consequently, in an LED lighting device containing the LED module 16, in addition to the advantages of the LED lighting device 1, the LED bare chips 16L are protected from static electricity, and therefore the device is highly reliable.

<Fourth Modification>

Figure 10:
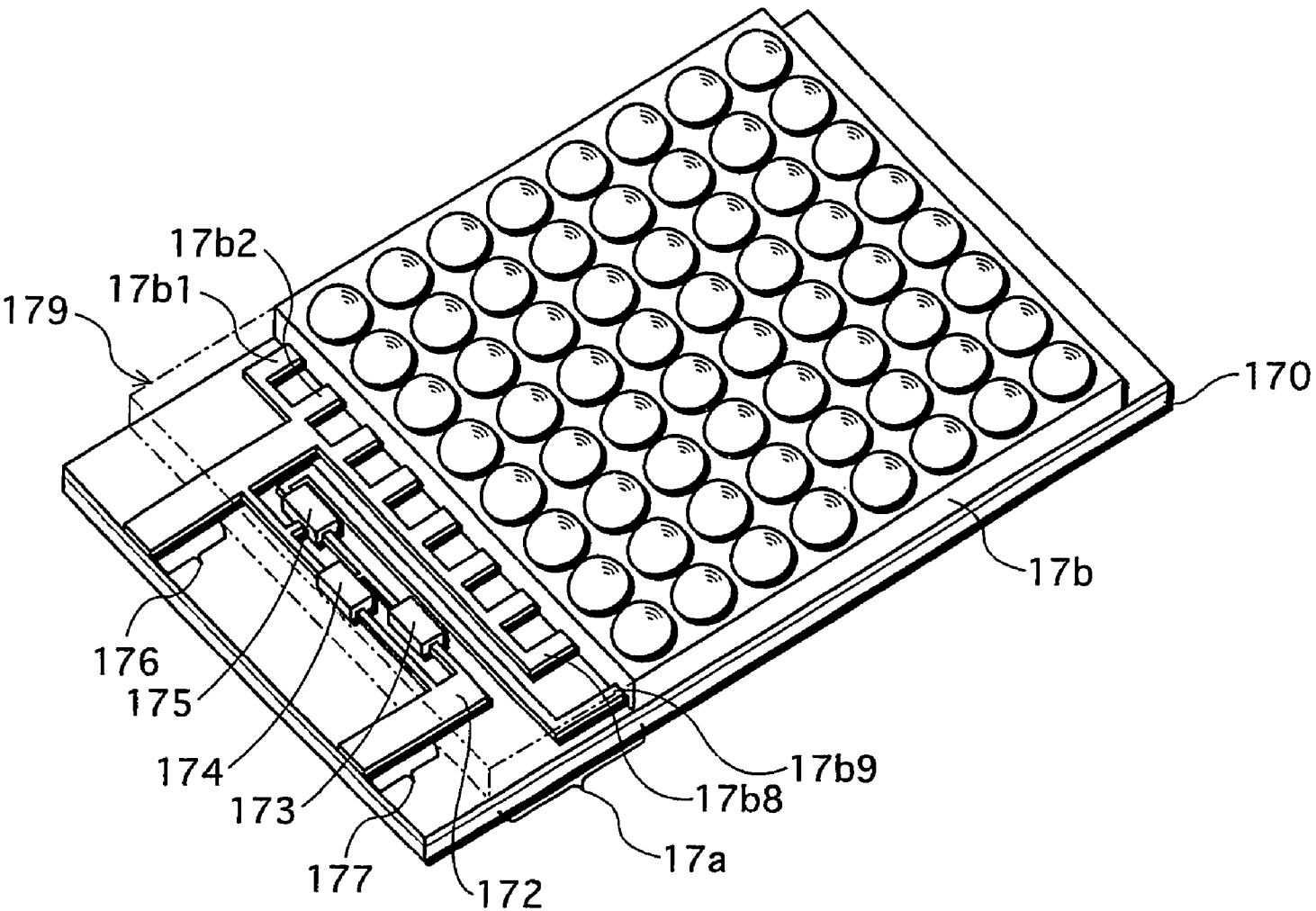
FIG. 10 is a perspective diagram (partially transparent view) showing an LED module 17 of a fourth modification.

The following describes an LED module 17 of a fourth modification with use of FIG. 10.

As shown in FIG. 10, in the LED module 17 of the present modification, chip components for the constant current circuit 17*a* are disposed directly on the conductive land 172 on the surface of the insulative layer of the main substrate 17.

In other words, instead of using a sub-substrate as described in the preferred embodiment, in the LED module 17 a resistor 173 and transistors 174 and 175 are mounted by in the necessary positions according die bonding using Ag paste or the like.

These circuit components 173, 174, and 175 are mounted around the time of the ultrasonic mounting of the LED bare chips, and lastly the area including the conductive land 172 is sealed with resin.

Note that the circuit structure of the LED module 17 is the same as that shown in FIG. 5, and the conductive land 172 is formed together with the connection terminals 176 and 177, the terminals 17*b*1, 17*b*2, through to 17*b*9 of the LED mounting unit 17*b* by etching of the metal layer on the insulative layer.

The LED module 17 with such a structure is superior in terms of weight and cost compared to the LED module 13 of the preferred embodiment, due to the lack of a sub-substrate such as the sub-substrate 131 in the LED module 13. Furthermore, a LED lighting device having the LED module 17 also has the same advantages as the LED lighting device 1.

<Fifth Modification>

The lighting device of the fifth modification is characterized in reducing the power supply to the LED module when an excessive rise in temperature occurs due to an abnormality, such as a short circuit, in the LED bare chips mounted on the LED module.

Specifically, the characteristics of the present modification are that the LED module includes an abnormality detection unit that detects abnormalities in the LED bare chips, and the constant voltage circuit unit includes a control unit that reduces power supply to the module socket (the LED modules) when the abnormality detection unit detects an abnormality in the LED bare chips.

The following describes the structure of two specific examples. Note that here "reducing the power supply" includes stopping the power supply.

1. FIRST EXAMPLE

Figure 11:
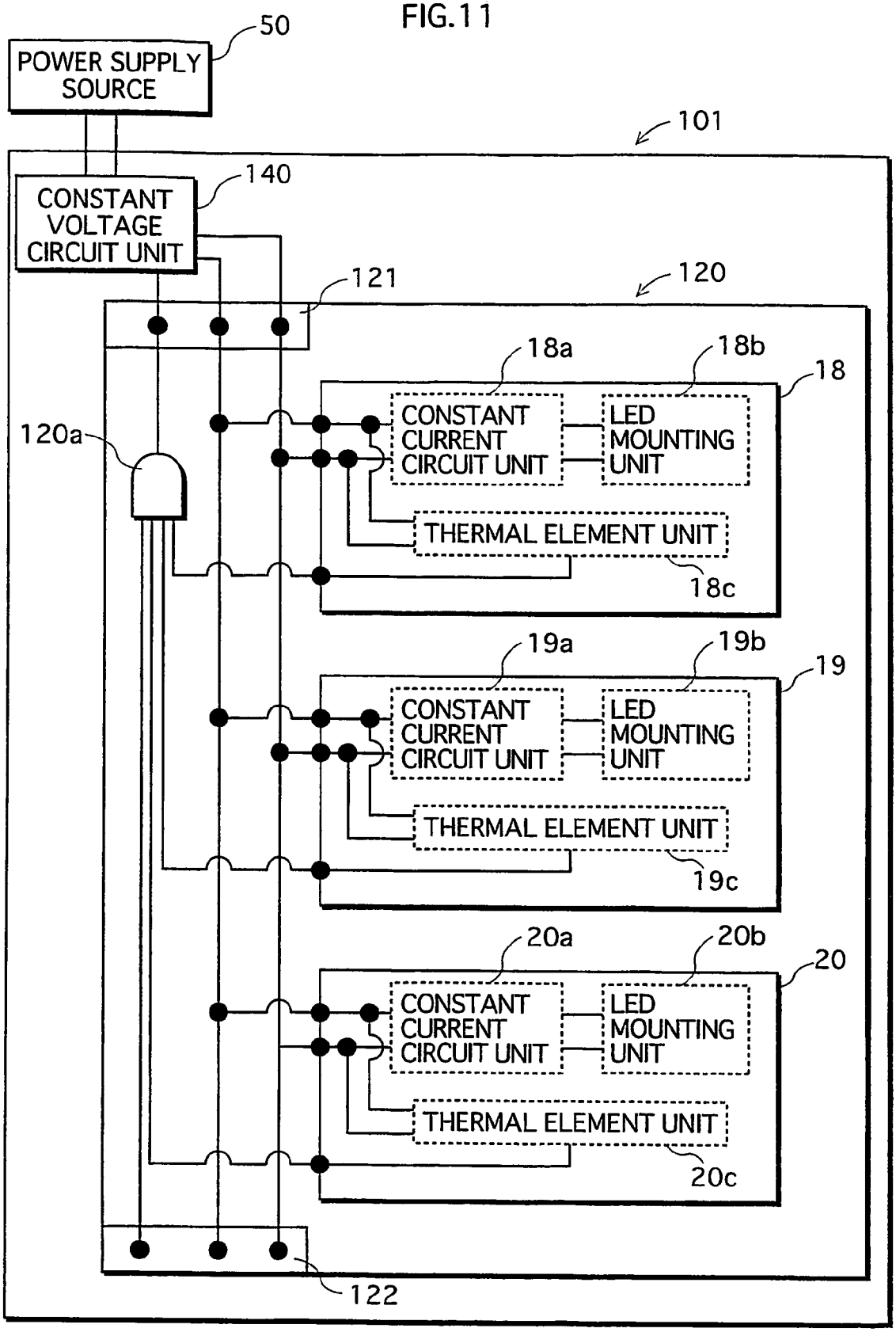
FIG. 11 is a block diagram showing circuits of an LED lighting device 101 of a fifth modification.
Figure 12:
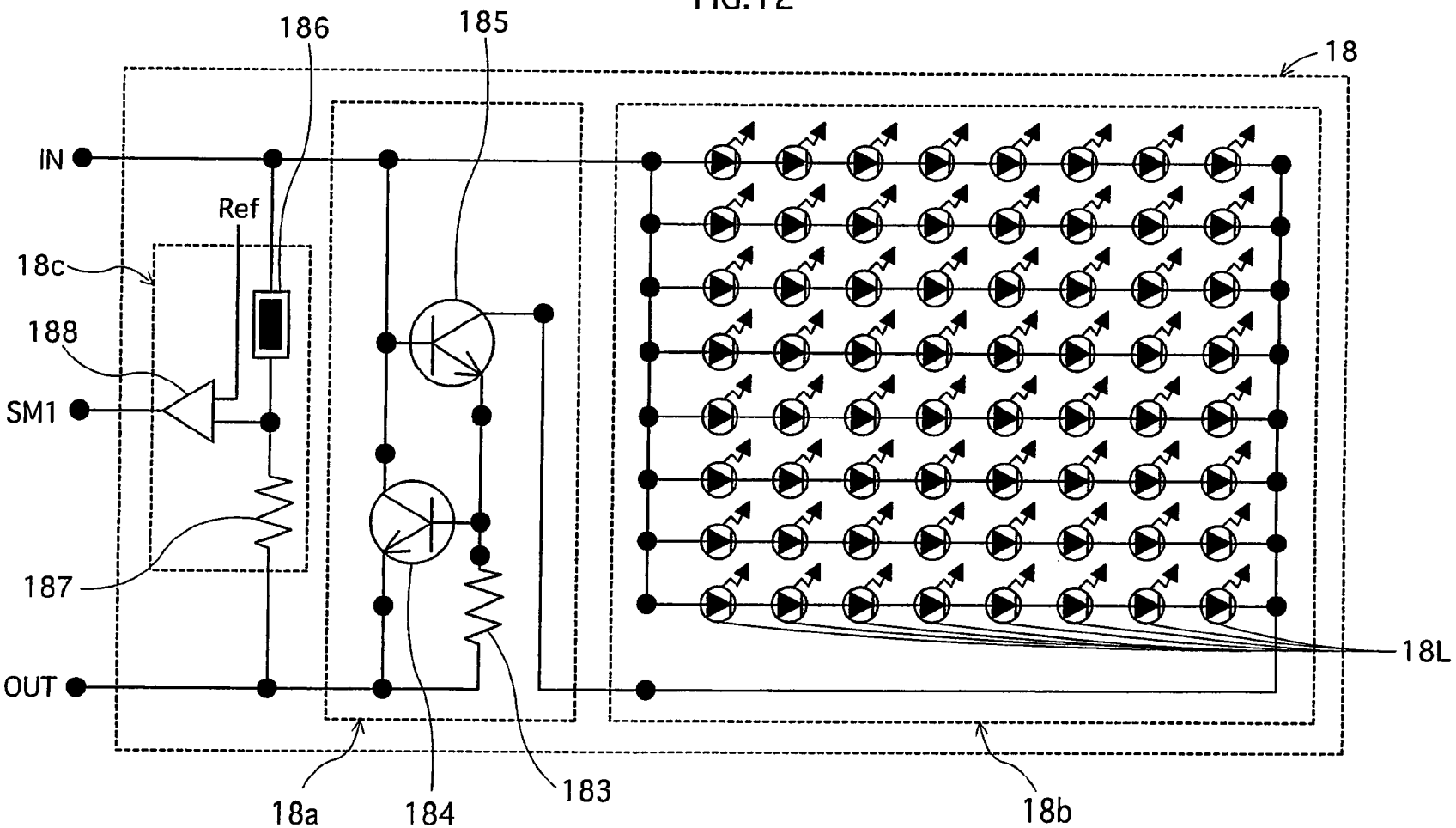
FIG. 12 is a circuit diagram of an LED module 18 of a first example of the fifth modification.
Figure 13:
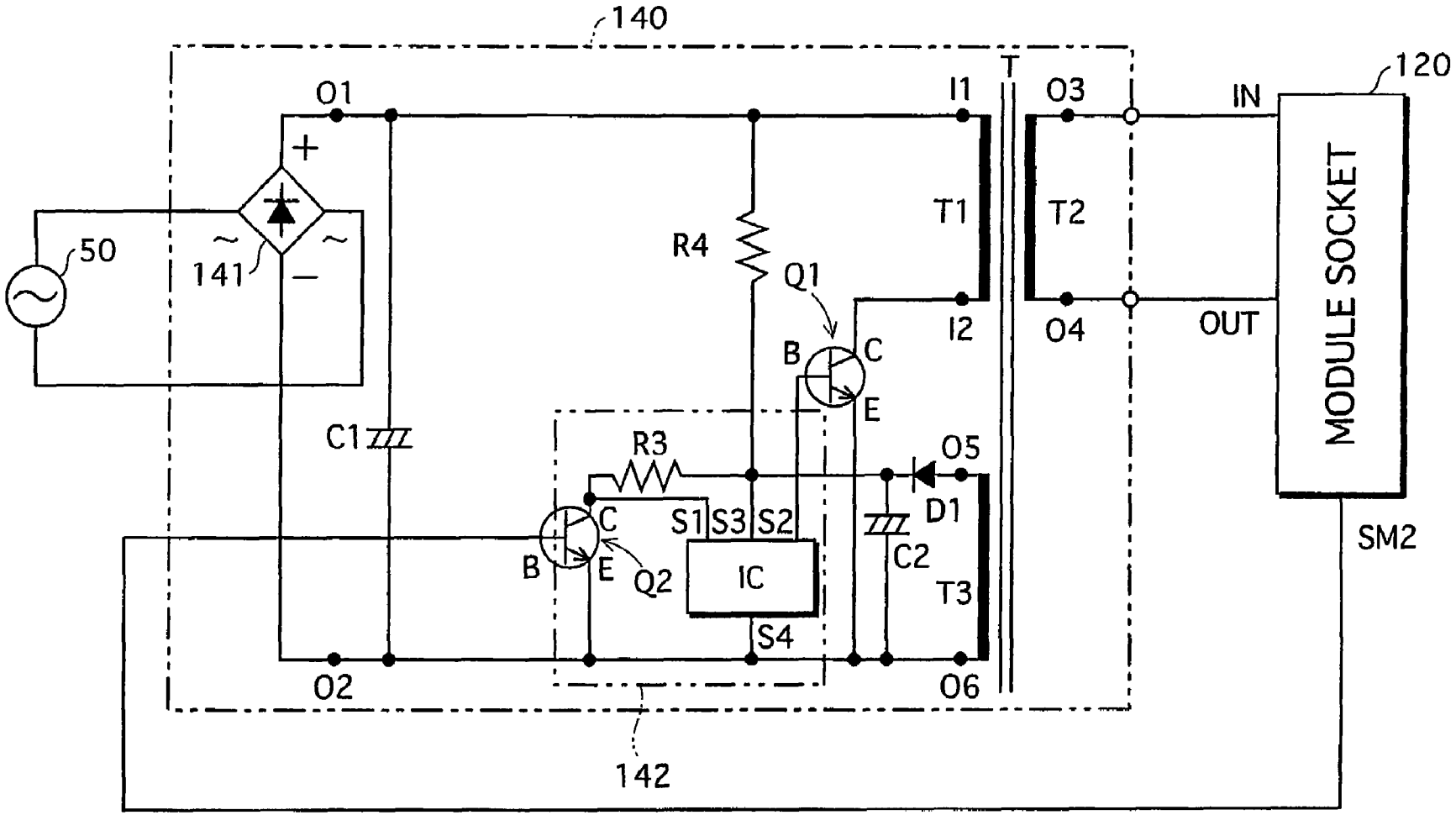
FIG. 13 shows the circuit structure of a constant voltage circuit unit 140 of the first example of the fifth modification.

The following describes, as the LED bare chip abnormality, the LED module exhibiting an excessive rise in temperature, with use of FIGS. 11 to 13.

As shown in FIG. 11, a lighting device 101 of the fifth modification includes a module socket 120 that has three detachable LED modules 18, 19 and 20, and a constant voltage circuit unit 140 that provides a constant voltage to the LED modules 18, 19 and 20. Note that the constant voltage circuit unit 140 and the module socket 120 are connected by three leads.

Each of the LED modules 18, 19 and 20 has substantially the same structure, and the following describes the structure of the LED module 18.

As shown in FIGS. 11 and 12, the LED module 18 has a constant current circuit unit 18*a*, an LED mounting unit 18*b*, and a thermal element 18*c*. Note that since the constant current circuit unit 18*a* and the LED mounting unit 18*b* are as described in the preferred embodiment, a description thereof is omitted here.

The thermal element 18*c* is for detecting heat abnormalities in the LED mounting unit 18*b* (in other words, the thermal element 18*c* is the abnormality detection unit of the present invention). As one example, as shown in FIG. 12, the thermal element 18*c* includes a thermistor 186, a resistor 187 and a comparator 188, and is connected in parallel with respect to the constant current circuit unit 18*a*.

Note that in FIG. 12 for convenience the thermistor 186 is shown as being some distance from the LED mounting unit 18*b*, but in reality it is positioned near the LED mounting unit 18*b*, and is able to detect a temperature abnormality in the LED bare chips 18L immediately.

Specifically, when the temperature of the LED mounting unit 18*b* is a temperature when a short of the like is not occurring (this case is referred to as "normal operation"), an H signal, for instance, is output by the comparator 188.

On the other hand, when the temperature of the LED mounting unit 18*b* rises exceedingly above the temperature during normal operation (this case is referred to as "abnormal operation"), the voltage input into the comparator 188 exceeds a reference voltage (corresponding to "Ref" in FIG. 12), and an L signal, for instance, is output by the comparator 188 (shown by "SM1" in FIG. 12).

The module socket 120 is basically the same as described in the preferred embodiment and the first to fourth modifications. However, as shown in FIG. 11, the module socket 120 includes a logical circuit unit 120*a*, and, for example, an AND gate, for outputting an L signal (shown as "SM2" in FIG. 13) to the constant voltage circuit unit 140 if an L signal is included in the signals SM1 output by the thermal element units 18*c*, 19*c* and 20*c* of the three LED modules 18, 19 and 20. The signal is output to the constant voltage circuit unit 140 via a lead connected to the connecter 121.

Note that in addition to the three LED modules 18, 19 and 20, a connector 122 is also connected to the logical circuit unit 120*a*. This is so that if the number of LED modules is expanded as described in the preferred embodiment, abnormalities can be detected in LED modules loaded in another module socket.

The constant voltage circuit unit 140 includes as its main compositional elements a recitfier 141, capacitor C1, an output trans T, transistors Q1 and Q2, and an IC, as shown in FIG. 13.

The rectifier 141 rectifies alternating current output from a commercial alternating power source 50. The capacitor C1 is connected between output ends O1 and O2 of the rectifier 141, and smoothes power rectified by the rectifier 141.

The output trans T has a primary winding T1 that is an input, and a secondary winding T2 and a tertiary winding T3 that are outputs. An input end I1 of the primary winding T1 is connected to the output end O1 of the rectifier 141, and an input end 12 of the primary winding T1 is connected to the connector C of the transistor Q1. Output ends O3 and O4 of the secondary winding T2 are connected to the module socket 120.

An output end O5 of the tertiary winding T3 is connected to an S3 terminal of the IC via a diode D1, and an output end O6 of the tertiary winding T3 is connected to the output end O2 of the rectifier 141. Furthermore, a capacitor C2 is connected between an output of the diode D1 and the output end O6 of the tertiary winding T3.

Note that an emitter E of the transistor Q1 is connected to the output end O6 of the tertiary winding T3, and a base B of the transistor Q1 is connected to an S2 terminal of the IC.

The transistor Q1 is either on (substantially a state of conduction between the collector and the emitter) or off (a state of non-conduction), based on a pulse signal from a signal output terminal S2 of the IC. This switches direct current voltage applied to the primary winding T1 by the output trans T, and has a constant voltage corresponding to the turns ratio output to the secondary winding T2 and the tertiary winding T3.

Furthermore, a control circuit 142 (the control unit of the present invention) is provided between the condenser C1 and the output trans T. The control circuit reduces the supply of power to the module socket 120 when an abnormality occurs in the LED bare chips of the LED module 18, 19 or 20.

When the output signal SM2 from the module socket 120 is an L signal, the control circuit 142 stops (reduces) power supply to the module socket 120 by stopping the switching of the transistor Q1.

The control circuit 142 includes an IC and an transistor Q2.

The IC is a commonly-known PWM switching power control IC, and controls switching operations of the transistor Q1. Here, S1 of the IC is a signal input terminal, S2 is a signal output terminal, S3 is a power input terminal, and S4 is connected to the output end O2 of the rectifier 141 by a ground terminal.

A power input terminal S3 of the IC is connected via a resistor R4 to the output end O1 of the rectifier 141, and is also connected via the diode D1 to the output end O5 of the tertiary winding T3 of the output trans T.

A signal input terminal S1 is connected to the collector C of the transistor Q2, and via a resistor R3 to the power input terminal S3. An emitter E of the transistor Q2 is connected to the output end O2 of the rectifier 141, and a base B of the transistor Q2 is connected to the module socket 120 (the logical circuit unit 120*a*).

With this structure, the constant voltage circuit unit 140 operates as follows.

<Normal Operation>

First, the constant voltage circuit unit 140 is connected to the power supply source 50, and the module socket 120 is connected via a lead to the constant voltage circuit unit 140. Power is supplied by the power supply source 50 via the constant voltage circuit unit 140 to the LED modules 18, 19 and 20.

Each of the LED modules 18, 19 and 20 receives the supply of power from the constant voltage circuit unit 140, and the LED bare chips (18L) in the LED mounting units 18*b*, 19*b* and 20*b* are illuminated.

Here, if the temperatures of the LED mounting units 18*b*, 19*b* and 20*b* in the LED modules 18, 19 and 20 are normal operation temperatures, the comparator 188 of each of the thermal elements 18*c*, 19*c* and 20*c* outputs an H signal (SM1) to the logical circuit unit 120*a*.

If all of the input signals SM1 from the comparators 188 are H signals, the logical circuit unit 120*a* outputs an H signal (SM2) to the constant voltage circuit unit 140.

Meanwhile, in the constant voltage circuit unit 140, the input alternating current power is rectified by the rectifier 141, and the resulting direct current voltage is applied via the resistor R4 to the power input terminal S3 of the IC. Charging of the capacitor C2 commences simultaneously. Here, the resistor R4 has a high resistance value in order to protect the IC, and when the capacitor C2 is fully charged, voltage to the IC reaches the IC operational voltage and the IC commences operation.

Furthermore, when there is no abnormality in the LED modules 18, 19 and 20, an H signal voltage is applied to the base B of the transistor Q2, Q2 is turned on (the collector and emitter are substantially in a state of conduction), and the IC signal input terminal S1 is substantially grounded (L level).

When an operation voltage is applied to the power input terminal S3 and the signal input terminal S1 is grounded, in other words at the L level, the IC outputs a pulse signal with a predetermined cycle and a predetermined duty ratio from the signal output terminal S2, thereby switching (turning on/off) the transistor Q1.

Accordingly, a voltage having a substantially rectangular waveform is applied to the primary winding T1 of the output trans T, and a voltage correspond to the winding ratio is output from the secondary winding T2 and the tertiary winding T3.

The LED bare chips in the LED modules 18, 19 and 20 are illuminated according this output from the secondary winding T2.

Note that the output from the tertiary winding T3, which also has a rectangular waveform, is rectified and smoothed by the diode D1 and the condenser C2, and applied to the power input terminal S3. That is to say that after commencement of switching by the transistor Q2, the output from the tertiary winding T3 becomes supply source of the operation voltage of the IC.

<Temperature Abnormality>

On the other hand, when a short circuit or the like occurs in one of the LED modules 18, 19 and 20, the temperature of the LED mounting units 18*a*, 18*b* and 18*c* in which the short circuit has occurred rises abnormally.

This rise in temperature lowers the resistance of the thermal elements 18*c*, 19*c* and 20*c* provided in the LED modules 13, 19 and 20, and when a voltage of at least a reference voltage is input into the comparator 188, the comparator 188 outputs an L signal (SM1) to the logical circuit unit 120*a*. The logical circuit unit 120*a* receives the L signal, and outputs an L signal (SM2) to the constant voltage circuit unit 140.

Since an output signal SM2 from the module socket 120 is an L signal, the transistor Q2 switches to off, and an output voltage of the output end O5 of the tertiary winding T3 of the output trans T is applied via the diode D1 and the resistor R3 to the IC signal input terminal S1 (hereinafter this stated is referred to as "H level").

When the signal input terminal S1 is at the H level, the IC stops output of the pulse signal from the signal output terminal S2, and stops the switching operation of the transistor Q1 (puts the transistor Q1 into an off state).

Accordingly, current no longer flows to the primary winding T1 of the output trans T, and the output of the secondary winding T2 and the tertiary wiring T3 are substantially zero. Consequently, the LED bare chips in the LED modules 18, 19 and 20 are extinguished.

Note that power supplied to the LED modules 18, 19 and 20 can be reduced by, for example, lengthening the off state of the on/off switching operations of the transistor Q1.

2. SECOND EXAMPLE

Figure 14:
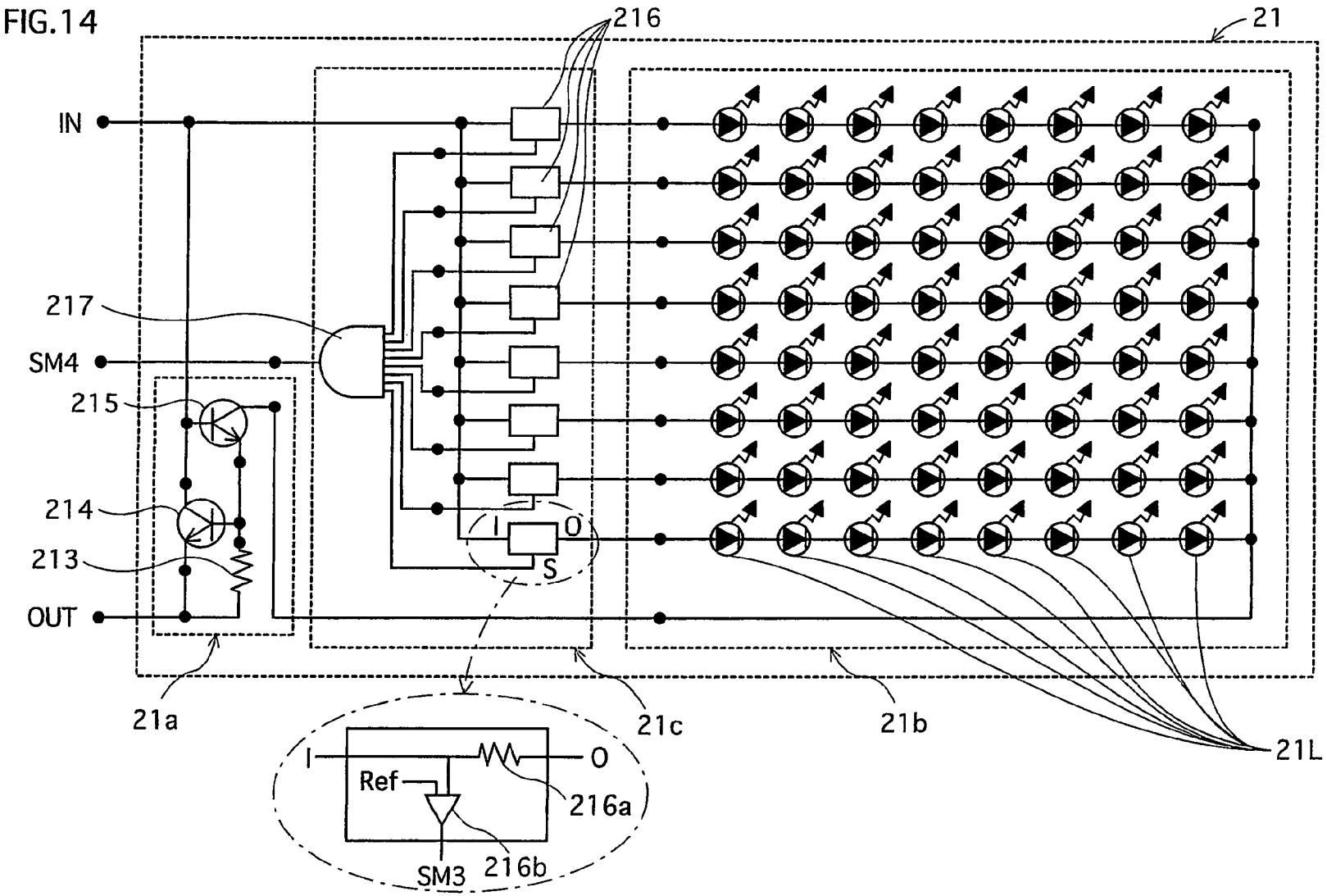
FIG. 14 is a circuit diagram of an LED module 21 of a second example of the fifth modification 5.

The following describes with use of FIG. 14 a case in which the amount of current in the LED bare chips increases excessively, as an example of an abnormality in the LED bare chips. Note that the module socket and constant voltage circuit unit of the present example are the same as those in the first example, and therefore descriptions thereof are omitted. Furthermore, since each of the LED modules in the present example has the same structure, the following describes an LED module 21.

The LED module 21 includes a constant current circuit unit 21*a*, an LED mounting unit 21*b* and a current detection unit 21*c*, as shown in FIG. 14. Note that the constant current circuit unit 21*a* and the LED mounting unit 21*b* are as described in the preferred embodiment, and therefore not described here.

The current detection unit 21*c* is for detecting current abnormalities in the LED mounting unit 18*b* (the current detection unit is the abnormality detection unit of the present invention), and includes, for example, resistors 216*a* and comparators 216*b*, as shown in FIG. 14. The current detection unit 21*c* is connected in series on the upstream side of the series groups of eight LED bare chips 21L connected in series. An output signal SM3 from each comparator 216*b* is output to the logical circuit unit 217.

Specifically, when there is no broken wire or the like in the LED bare chips 21L in the eight lines of series groups (this state corresponds to "normal operation" in the first example), each comparator 216*b* outputs, for example, an H signal as described in the first example. Conversely, when there is a broken wire or the like in the LED bare chips 21L and the current amount in one of the series groups increases (this state corresponds to "abnormal operation" in the first example), the voltage input into the respective comparator 216*b* becomes equal to, or higher than a reference voltage, and the comparator 216*b* outputs, for example, an L signal ("SM3" in FIG. 14).

The signal SM3 from the comparator 216*b* of each series is output to the logical circuit unit 217. If all the input signals SM3 from the comparators 216*b* are H signals, the logical circuit unit 217 outputs an H signal (SM4) to the constant voltage circuit unit, and if an L signal is included in the input signals SM3 from the comparators 216*b*, the logical circuit unit 217 outputs an L signal (SM4) to the constant voltage circuit unit. If the constant voltage unit receives an L signal (SM4), the constant voltage circuit supplies to all the LED modules, power to the power supply terminal such that the luminous intensity stabilization circuit reduces or stops current supplied to the LED mounting unit.

3. CONCLUSION

In the described first and second examples, an abnormality that occurs in one of the LED mounting units 18*b*, 19*b*, 20*b* and 21*b* is detected by the abnormality detection unit (the thermal element unit in the first example and the current detection unit in the second example), and the supply of power to the module socket is stopped.

This, for example, prevents heat caused by an excessive rise in temperature in one of the LED mounting units in the plurality of LED modules from being conducted by the heat radiating plate 30 (see FIGS. 1 and 2) and causing the other modules to rise in temperature. Note that if heat is transferred to other LED modules causes the LED modules to rise in temperature, the lifespan of the LED bare chips is shortened.

4. OTHER a. Regarding the Lighting Device

In the lighting device in the fifth modification the module socket and the constant voltage circuit unit are separate components, however they may be formed as one. This construction also enables power supply to the LED bare chips to be reduced when an abnormality occurs in an LED mounting unit, therefore prevents excessive rises in temperature of the LED modules and breakage or mis-operation of the constant voltage circuit unit.

b. Regarding the Constant Voltage Circuit Unit

The fifth example simply indicates one example of the circuit structure of the constant voltage circuit unit. A constant voltage circuit unit having a different structure, such as one that includes an op-amp, may be used.

c. Regarding the LED Modules

The LED modules are not limited to being detachable as described in the fifth modification. In other words, the feature of the present modification is the structure by which power supply to the LED bare chips of the LED mounting unit is reduced when an abnormality occurs in the LED mounting unit.

Consequently, it is sufficient for the lighting device to include one or a plurality of LED bare chips; an illumination circuit for illuminating the LED bare chip or chips; and abnormality detection means for detecting an abnormality, such as a temperature rise or an increase in current, in the LED bare chip or chips during illumination; and for the illumination circuit to include a control circuit for reducing power supply to the LED bare chip or chips when the abnormality detection means detects and abnormality in the LED bare chip or chips.

The illumination circuit may, for example, include a rectifying/smoothing circuit that rectifies and smoothes power from the power supply source, a switching element that switches the output from the rectifying/smoothing circuit, and an output trans whose primary side is connected (in series for example) to the switching element with respect to the rectifier (141). The control circuit may, for example, control the operations of the switching element of the illuminating circuit, and reduce (here, reducing includes stopping) the output of the output trans.

Other Remarks

The preferred embodiment and first to fifth modifications of the present invention are examples given to describe the structure and effects of the present invention, and the present invention is not limited to these examples. For example, instead of using the resin sub-substrate 131 to mount the structural components of the constant current circuit, a ceramic substrate or an Si substrate may be used. Use of an Si substrate is particularly advantageous in obtaining a compact, low-cost current circuit unit because the transistor area and the resistance area can be formed by diffusion.

Furthermore, the circuit structure of the constant current circuit unit is not limited to the examples given in the preferred embodiment and the modifications. For example, the constant current circuit may include an op-amp.

Furthermore, although an example of a constant current circuit being used as the circuit to stabilize luminous intensity of the LED bare chips is given in the preferred embodiment, a constant voltage circuit may be used instead. However, generally it is desirable to use constant current control for LED control.

Furthermore, although the LED modules 11, 12 and 13 in FIG. 1 are fixed in the module socket 20, if the magazine units 20*a*, 20*b* and 20*c* of the LED modules 11, 12 and 13 have a movable structure, workability can be improved when replacing the LED modules 11, 12 and 13. For example, if the lighting device is such that the module socket has a hinge mechanism which acts as an axis to enable the magazine unit to be raised from a base portion which is fixed to the main body of the lighting device, the LED modules can be replaced without removing the module socket from the lighting device, by simply raising the magazine unit.

INDUSTRIAL APPLICABILITY

The lighting device of the present invention can be used for stabilizing luminous intensity, and allows LED modules to be easily replaced or increased in number with LED modules of differing specifications.

The invention claimed is:

1. A lighting device including a plurality of LED modules, each LED module in the plurality of LED modules comprising:

a main substrate;

an LED mounting unit composed of one or more LED bare chips mounted on a main surface of the main substrate;

a power supply terminal provided on the main surface of the main substrate, and operable to receive power from an electric power source;

a luminous intensity stabilization circuit connected electrically to the power supply terminal and the LED mounting unit; and a thermal element unit connected to the luminous intensity stabilization circuit, and including a thermal element and a first comparator provided in a vicinity of an area in which the one or more LED bare chips are mounted, wherein when at least one of the LED bare chips in any one of the LED modules rises in temperature to a predetermined temperature or higher, the luminous intensity stabilization circuit stops current to the one of the LED modules independently from any other of the LED modules in the plurality of LED modules, according to a judgment signal from the first comparator based on detected temperature information from the thermal element, and each of the LED modules is individually detachable from the lighting device.

2. The lighting device of claim 1, wherein the luminous intensity stabilization circuit is a constant current circuit.

3. A lighting device comprising:

a plurality of LED modules, each LED module in the plurality of LED modules including:

a main substrate, an LED mounting unit composed of one or more LED bare chips mounted on a main surface of the main substrate, a power supply terminal provided on the main surface of the main substrate, and operable to receive power from an electric power source, a luminous intensity stabilization circuit connected electrically to the power supply terminal and the LED mounting unit, a thermal element unit connected to the luminous intensity stabilization circuit, and including a thermal element and a first comparator provided in a vicinity of an area in which the one or more LED bare chips are mounted;

one constant voltage circuit supplying a constant voltage to each LED module, using power from a power supply source; and one logical circuit electrically connected to the constant voltage circuit and the thermal element unit of each LED module, wherein, when at least one LED bare chip in at least one LED module rises in temperature to a predetermined temperature or higher, the constant voltage circuit supplies to all the LED modules, power to the power supply terminals such that the luminous intensity stabilization circuits stop current supplied to at least one of the LED mounting unit independently from any other LED modules in the plurality of LED modules, based on instruction information output from the logical circuit that is received, from the thermal element unit of the at least one LED module, a judgment signal of the first comparator based on detected temperature information of the thermal element of the at least one LED module.

4. A lighting device comprising:

a plurality of LED modules, each LED module in the plurality of LED modules including:

a main substrate, an LED mounting unit composed of one or more LED bare chips mounted on a main surface of the main substrate, a power supply terminal provided on the main surface of the main substrate, and operable to receive power from an electric power source, a constant current circuit connected electrically to the power supply terminal and the LED mounting unit, a thermal element unit connected to the constant current circuit, and including a thermal element and a first comparator provided in a vicinity of an area in which the one or more LED bare chips are mounted;

one constant voltage circuit supplying a constant voltage to each LED module, using power from a power supply source; and one logical circuit electrically connected to the constant voltage circuit and the thermal element unit of each LED module, wherein, when at least one LED bare chip in at least one LED module rises in temperature to a predetermined temperature or higher, the constant voltage circuit supplies to all the LED modules, power to the power supply terminals such that the constant current circuits stop current supplied to at least one of the LED mounting unit independently from any other LED modules in the plurality of LED modules, based on instruction information output from the logical circuit that is received, from the thermal element unit of the at least one LED module, a judgment signal of the first comparator based on detected temperature information of the thermal element of the at least one LED module, and each of the LED modules is individually detachable from the lighting device.

5. A lighting device comprising:

a plurality of LED modules, each LED module in the plurality of LED modules including:

a main substrate, an LED mounting unit composed of one or more LED bare chips mounted on a main surface of the main substrate, a power supply terminal provided on the main surface of the main substrate, and operable to receive power from an electric power source, a luminous intensity stabilization circuit connected electrically to the power supply terminal and the LED mounting unit, a thermal element unit connected to the luminous intensity stabilization circuit, and including a thermal element and a first comparator provided in a vicinity of an area in which the one or more LED bare chips are mounted, and a current detection unit including a second comparator connected to the one or more LED bare chips to detect a current amount, wherein when at least one of the LED bare chips in any one of the LED modules rises in temperature to a predetermined temperature or higher, the luminous intensity stabilization circuit stops current to the one of the LED modules independently from any other of the LED modules in the plurality of LED modules, according to a judgment signal from the first comparator based on detected temperature information from the thermal element;

a constant voltage circuit supplying a constant voltage to each LED module, using power from a power supply source; and a logical circuit electrically connected to the constant voltage circuit and the current detection unit, wherein when the current amount in at least one LED bare chip in at least one LED module rises above a predetermined current amount, the constant voltage circuit supplies to all the LED modules, power to the power supply terminal such that the luminous intensity stabilization circuit reduces or stops current supplied to the LED mounting unit, based on instruction information output from the logical circuit that received, from the current detection unit of the at least one LED module, a judgment signal of the second comparator based on the detected current amount of the at least one LED module, and each of the LED modules is individually detachable from the lighting device.

6. A lighting device comprising:

a plurality of LED modules, each LED module in the plurality of LED modules including:

a main substrate, an LED mounting unit composed of one or more LED bare chips mounted on a main surface of the main substrate, a power supply terminal provided on the main surface of the main substrate, and operable to receive power from an electric power source, a constant current circuit connected electrically to the power supply terminal and the LED mounting unit, a thermal element unit connected to the constant current circuit, and including a thermal element and a first comparator provided in a vicinity of an area in which the one or more LED bare chips are mounted, and a current detection unit including a second comparator connected to the one or more LED bare chips to detect a current amount, wherein when at least one of the LED bare chips in any one of the LED modules rises in temperature to a predetermined temperature or higher, the constant current circuit stops current to the one of the LED modules independently from any other of the LED modules in the plurality of LED modules, according to a judgment signal from the first comparator based on detected temperature information from the thermal element;

a constant voltage circuit supplying a constant voltage to each LED module, using power from a power supply source; and a logical circuit electrically connected to the constant voltage circuit and the current detection unit, wherein when the current amount in at least one LED bare chip in at least one LED module rises above a predetermined current amount, the constant voltage circuit supplies to all the LED modules, power to the power supply terminal such that the constant current circuit reduces or stops current supplied to the LED mounting unit, based on instruction information output from the logical circuit that received, from the current detection unit of the at least one LED module, a judgment signal of the second comparator based on the detected current amount of the at least one LED module, and each of the LED modules is individually detachable from the lighting device.

7. A lighting device comprising:

a plurality of LED modules;

a constant voltage circuit supplying a constant voltage to each LED module, using power form a power supply source; and a logical circuit electrically connected to the constant voltage circuit and a thermal element unit in each of the LED modules, wherein each LED module includes:

a main substrate;

an LED mounting unit composed of one or more LED bare chips mounted on a main surface of the main substrate;

a power supply terminal provided on the main surface of the main substrate, and operable to receive voltage from the constant voltage circuit;

a constant current circuit connected electrically to the power supply terminal and the LED mounting unit; and the thermal element unit connected to the constant current circuit, and including a thermal element and a comparator provided in a vicinity of an area in which the one or more LED bare chips are mounted;

wherein when at least one of the LED bare chips in any one of the LED modules rises in temperature to a predetermined temperature or higher, the constant voltage circuit stops voltage supply to the one of the LED modules independently from any other of the LED modules in the plurality of LED modules, according to a judgment signal from the comparator based on detected temperature information from the thermal element, and each of the LED modules is individually detachable from the lighting device.

8. A lighting device comprising:

a plurality of LED modules, each LED module in the plurality of LED modules including:

a main substrate, an LED mounting unit composed of one or more LED bare chips mounted on a main surface of the main substrate, a power supply terminal provided on the main surface of the main substrate, and operable to receive power from an electric power source, a constant current circuit connected electrically to the power supply terminal and the LED mounting unit, a thermal element unit connected to the constant current circuit, and including a thermal element and a first comparator provided in a vicinity of an area in which the one or more LED bare chips are mounted, and a current detection unit including a second comparator connected to the one or more LED bare chips to detect a current amount;

a constant voltage circuit supplying a constant voltage to each LED module, using power from a power supply source;

a first logical circuit electrically connected to the constant voltage circuit and the thermal element unit of each LED module, wherein, when at least one LED bare chip in at least one LED module rises in temperature to a predetermined temperature or higher, the constant voltage circuit supplies to all the LED modules, power to the power supply terminal such that the constant current circuit stops current supplied to the LED mounting unit, based on instruction information output from the first logical circuit that is received, from the thermal element unit of the at least one LED module, a judgment signal of the first comparator based on detected temperature information of the thermal element of the at least one LED module; and a second logical circuit electrically connected to the constant voltage circuit and the current detection unit, wherein when the current amount in at least one LED bare chip in at least one LED module rises above a predetermined current amount, the constant voltage circuit supplies to all the LED modules, power to the power supply terminal such that the constant current circuit stops current supplied to the LED mounting unit, based on instruction information output from the second logical circuit that received, from the current detection unit of the at least one LED module, a judgment signal of the second comparator based on the detected current amount of the at least one LED module.

9. The lighting device of claim 8, wherein each of the LED modules is individually detachable from the lighting device.

* * * * *